US006443368B1

(12) United States Patent
Kohls

(10) Patent No.: US 6,443,368 B1
(45) Date of Patent: Sep. 3, 2002

(54) GARDENING APPLICATOR FOR DELIVERING LIQUID CHEMICALS TO SELECTED VEGETATION

(76) Inventor: Corwin Kohls, 989 Patriot Sq., Dayton, OH (US) 45459

( * ) Notice: Subject to any disclaimer, the term of this patent is extended or adjusted under 35 U.S.C. 154(b) by 0 days.

(21) Appl. No.: 09/697,806

(22) Filed: Oct. 27, 2000

Related U.S. Application Data

(63) Continuation-in-part of application No. 09/309,476, filed on May 10, 1999, now Pat. No. 6,145,756.

(51) Int. Cl.[7] ..... B05B 1/28

(52) U.S. Cl. ..... 239/288; 239/524; 239/428.5; 239/600; 239/333; 239/526

(58) Field of Search ..... 239/288, 288.5, 239/104, 600, 343, 590.3, 120, 499, 524, 428.5, 333, 526; 222/108

(56) References Cited

U.S. PATENT DOCUMENTS

| | | | | | |
|---|---|---|---|---|---|
| 2,514,107 | A | | 7/1950 | Trostler | |
| 2,574,024 | A | | 12/1951 | Lundberg | |
| 2,597,573 | A | | 5/1952 | Groff | |
| 2,624,622 | A | | 1/1953 | Holte | |
| 2,789,396 | A | * | 4/1957 | Jernander et al. | 47/1.5 |
| 2,928,610 | A | * | 3/1960 | Fenimore | 239/288 |
| 2,965,309 | A | | 12/1960 | Parrott | |
| 3,094,171 | A | | 6/1963 | Gagliardo | |
| 3,935,999 | A | | 2/1976 | Weyn | |
| 3,946,947 | A | | 3/1976 | Schneider | |
| 4,199,896 | A | | 4/1980 | Lehmen | |
| 4,219,159 | A | | 8/1980 | Wesner | |
| 4,789,103 | A | | 12/1988 | Ruhnke | |
| 4,865,257 | A | * | 9/1989 | Bailey | 239/288.5 |
| 4,886,122 | A | | 12/1989 | Goodnight | |
| 4,986,473 | A | | 1/1991 | Semple et al. | |
| 5,085,371 | A | | 2/1992 | Paige | |
| 5,196,065 | A | * | 3/1993 | Jozwiak | 118/504 |
| 5,310,116 | A | | 5/1994 | Broyhill | |
| 5,344,076 | A | | 9/1994 | Mercurio | |
| 5,360,165 | A | * | 11/1994 | Singhal | 239/288 |
| 5,397,060 | A | | 3/1995 | Maas et al. | |
| 5,419,077 | A | | 5/1995 | Tombarelli | |
| 5,419,493 | A | | 5/1995 | Redway | |
| 5,609,272 | A | * | 3/1997 | Brass et al. | 222/147 |

* cited by examiner

*Primary Examiner*—Lesley D. Morris
*Assistant Examiner*—Dinh Q. Nguyen
(74) *Attorney, Agent, or Firm*—R. William Graham

(57) ABSTRACT

A gardening applicator for efficiently delivering liquid chemicals to selected vegetation is disclosed. The applicator includes a wind guard chamber through which a stream of emitted liquid chemicals may be directed in a predetermined path along a central axis of the wind guard chamber. The wind guard chamber is preferably tube shaped over a predetermined length and can incorporate a diffuser screen or mesh which extends transversely across the predetermined path at the exit end of the wind guard chamber such that the liquid chemicals are finely dispersed upon passing through the diffuser screen. Actuation of a pressure activated pump head may provide a pressurized stream of liquid chemicals through the wind guard chamber and onto the diffuser screen where it is dispersed in a uniform circular pattern onto selected vegetation. The pressure activated pump head may conveniently be connectable to a liquid chemical reservoir such as a generally commercially available bottle with a standard sized threaded opening. The wind guard chamber may further include a drip ring which creates a drip reservoir disposed inside the wind guard chamber. A preferably flared, transparent wind shield may further be provided on the exit end of the wind guard chamber to protect against unwanted overspray onto unintended vegetation.

32 Claims, 25 Drawing Sheets

L
P

GARDENING APPLICATOR FOR DELIVERING LIQUID CHEMICALS TO SELECTED VEGETATION

This is a continuation-in-part of U.S. Ser. No. 09/309,476 filed May 10, 1999, which now is U.S. Pat. No. 6,145,756.

BACKGROUND OF THE INVENTION

1. Field of the Invention

The disclosed invention relates to liquid chemical applicators for use in gardening applications. More particularly, the invention relates to applicators which effectively control the delivery of liquid chemicals dispersed onto selected weeds or other vegetation, while still protecting adjacent vegetation against unwanted chemical contact. The applicator is also designed to provide the user with optimum personal safety from the liquid chemicals.

2. Related Art

There exist various types of devices and methods for delivering liquid chemicals to vegetation. For example, different prior art methods employ the use of spraying of chemicals directly onto selected weeds or vegetation. The devices involved in the spray methods may include a reservoir of liquid chemicals to which is connected a pumping mechanism and a spray nozzle. Some of these devices are automated while others are manually manipulated.

Regardless of the device or method, it is of concern that the liquid chemicals be delivered to the intended site in a safe and efficient manner. Problems which exist in the art of the delivering such liquid chemicals may include unwanted chemical drift, excessive dripping, and overspray which can occur in a conventional spray application process. Drift may occur as a result of the wind blowing small particles of the liquid chemicals off of their intended path. Dripping may occur as a result of excess liquid chemicals falling out of the nozzle or off of a connected shield, and onto vegetation not intended to be sprayed, as the applicator is moved from one position to another. Drips can thus occur with sprayers that use special guards, bellows, bowls or cardboard shields. Drips can collect on these shields or different devices and fall upon the wrong vegetation. Overspray may occur when the sprayer oversprays the intended vegetation and sprays nearby wrong or unintended vegetation.

There has also been a problem of not being able to stand erect and having to bend over to apply the chemicals with various sprayers. There has been provided by some manufactures a pressurized tank with a fluid extension conduit which is several feet in length having a nozzle at one end in an attempt to address this problem. While this has aided in saving back problems from occurring, it has not addressed the other problems above-mentioned.

Another problem which can exist with many prior devices is that of waste of chemicals which is a by-product of unwanted drift, drip or overspray as previously described. Still, another problem may exist with respect to obtaining effective liquid chemical coverage of the vegetation targeted, which problem is sometimes referred to as poor spray pattern or poor spray pattern coverage. User safety also remains a significant problem.

The disclosed invention aims to address the above-listed and other problems by providing efficient methods and low cost practical devices permitting controlled applications of liquid chemicals to targeted vegetation.

SUMMARY OF THE INVENTION

One object of the invention is to improve gardening and yard work by reducing the time spent on liquid chemical applications such as for weeding.

Another object is to make it easier to apply liquid chemicals while standing erect.

A further object is to minimize dangers to any person using different garden chemicals from accidents or unwanted chemical contact.

It is still another object to improve delivery and safety of applying various liquid chemicals onto intended vegetation and not onto unintended vegetation.

Another object is to improve control of chemical drift, dripping and overspray.

It is yet another object to conserve cost of chemicals by minimizing usage.

It is another object to enable efficient application of liquid chemicals on selected vegetation during windy days or during less than perfect wind conditions.

It is still another object of the invention to enable efficient application of liquid chemicals to vegetation growing in hard to reach area such as along fences rows, building foundations, etc.

Accordingly, the invention is directed to a convenient gardening applicator for making gardening easier by improving the delivery system of liquid chemicals onto selected vegetation. The applicator includes a wind guard chamber through which a stream of ejected liquid chemicals may be directed in a predetermined path along a central axis of the wind guard chamber. The wind guard chamber is preferably tube shaped with a predetermined length and constructed of a transparent material.

A diffuser screen or mesh may be connected to the exit end of the wind guard chamber and preferably extends transversely across the predetermined path of the ejected chemical stream. Upon actuating a pressurized chemical source, such as a pressure activated pump head, the liquid chemical may be discharged through a discharging jet or nozzle element, through the wind guard chamber in a relatively straight thin stream and dispersed upon passing through the diffuser screen. The wind guard chamber may further incorporate a drip ring positioned on the inside of the wind guard chamber adjacent the chamber's exit end to collect drips. A preferably detachable and adjustable transparent windshield may be added to the assembly, e.g., at the exit end of the wind guard chamber, to add protection against unwanted chemical drift and overspray.

Other optional features, objects and advantages of the invention will be readily apparent to those skilled in the art upon viewing the appended drawings and reading the detailed description of the presently preferred embodiments hereafter.

DESCRIPTION OF THE PRESENTLY PREFERRED EMBODIMENTS

Figure 1:
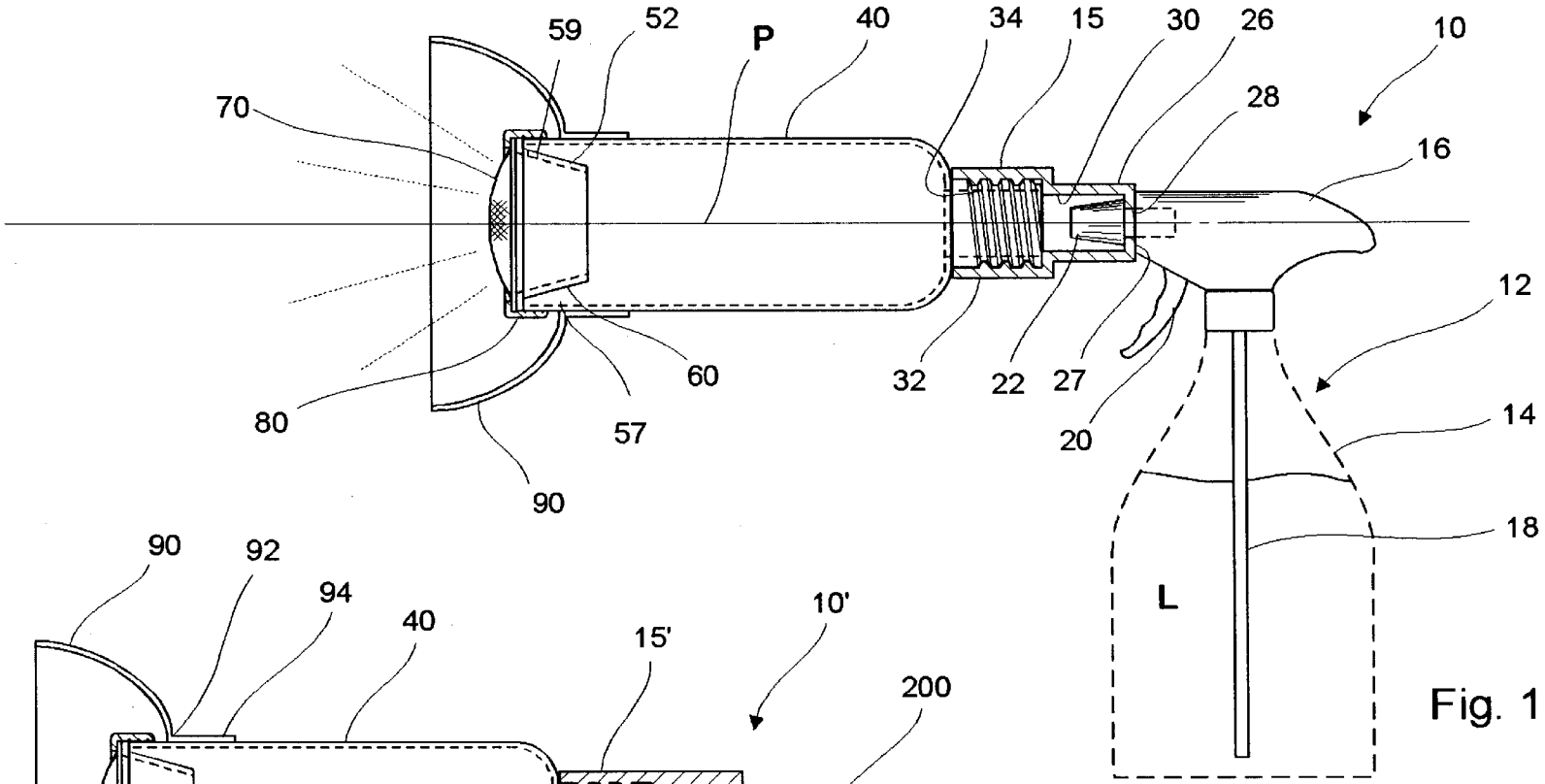
FIG. 1 is a cross-sectional view of a presently preferred embodiment of the invention.

While the invention is discussed herein as applied to gardening, home, yard use and the like, it is understood that other applications of the disclosed invention, such as commercial applications, will be apparent to those skilled in the art. And while the disclosed applicators are particularly useful for weed control and eradication of unwanted vegetation, it will be appreciated that they may also be advantageously deployed for controlled application of insecticides, nutrients, fertilizers and other liquid chemicals.

Referring now to the drawings, the presently preferred embodiments of gardening applicators according to the invention are generally depicted by the numerals 10, 10' and 10", where 10, 10' 10", 10''', 10'''', 10''''', 10'''''', 10''''''', 10'''''''', 10''''''''', 10'''''''''', 10''''''''''', 10'''''''''''', represent different embodiments shown in FIGS. 1, 3, 4, 6–8. The applicator embodiments 10, 10' and 10", where 10, 10' 10", 10''', 10'''', 10''''', 10'''''', 10''''''', 10'''''''', 10''''''''', 10'''''''''', 10''''''''''', 10'''''''''''' may include common elements and the numerals referred to herein will thus be the same where common elements are illustrated.

The illustrated gardening applicators 10, 10' and 10", where 10, 10' 10", 10''', 10'''', 10''''', 10'''''', 10''''''', 10'''''''', 10''''''''', 10'''''''''', 10''''''''''', 10'''''''''''' can predominatly be made of plastic materials, such as moldable thermoplastics, but other materials of natural or synthetic compositions can also be employed. Transparent materials can be particularly advantageous and are preferred where their use will facilitate visualization of the chemicals being applied.

As shown in FIG. 1, the gardening applicator 10 may be configured to be adapted to a conventional liquid chemical bottle 12. The depicted liquid chemical bottle 12 comprises a container 14 having a standard sized threaded opening attached to a pressure activated pump head 16 which is equipped with a lower feed line 18, a pump trigger 20 and a detachable discharging jet 22 that may be generally configured as known in the art. The discharging jet 22 is preferably threaded to the pressure activated pump head 16 and comprises an orifice 23 (shown in FIG. 5) through which a pressurized stream of liquid chemical L may be discharged along a predetermined path P.

Figure 5:
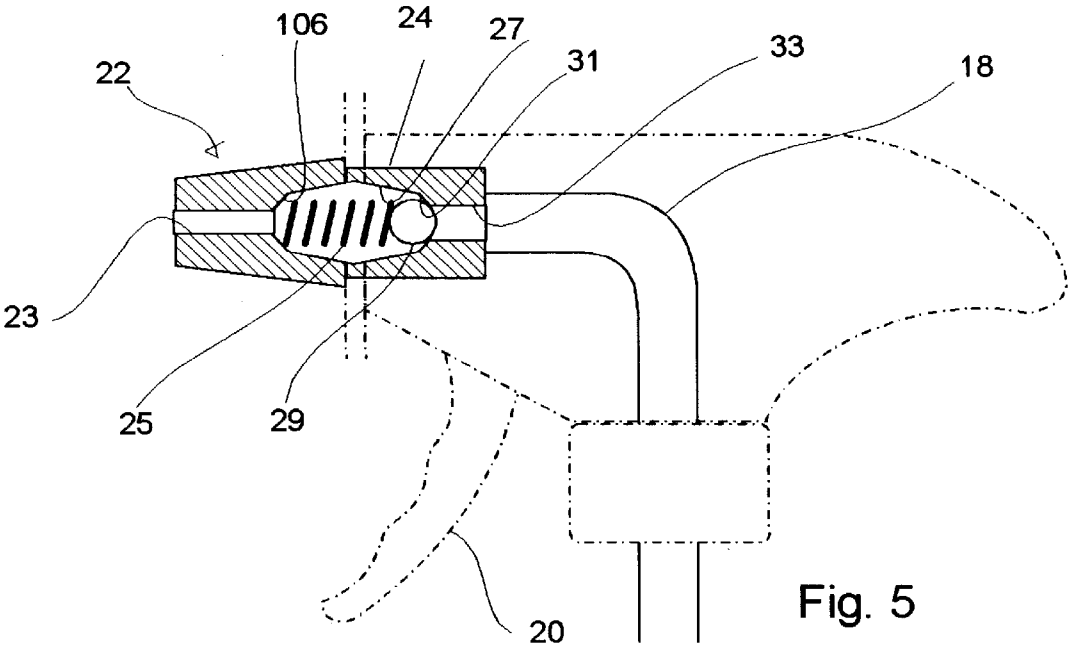
FIG. 5 is a part cross-sectional view of exemplary parts (discharging jet 22 and pressure control assembly 24) of the invention embodiments shown, e.g., in FIGS. 1, 2 and 4.

The discharging jet 22 may include a pump pressure control assembly 24 therein as depicted in FIG. 5, for example. The pump pressure control assembly 24 may include a non-drip check ball valve readily known in the art, but could include various other available check valves which would serve this exemplary function in the invention. The illustrated pressure pump control assembly 24, for example, includes a spring 25 disposed in a chamber 27 and a ball 29 which is biased against an orifice seat 31 within the discharging jet 22. A communicating port 33 interconnects upper portion of feed line 18 and orifice 23. The pump trigger 20 builds pressure to enable fluid flow in the direction of the discharging jet 22 from the feed line 18. Upon reaching a predetermined pressure in the feed line 18, liquid L is forced through the exemplary pressure control assembly 24 by displacing the ball 29 from the orifice seat 31 thus emitting liquid L through the orifice 23 as a stream at a controlled pressure level.

A wind guard chamber 40 is also provided and a presently preferred example is depicted in FIGS. 1, 2, 3, 6–9, 10–15, 25, 27, 29, and 30. The chamber 40 as specifically described herein in FIG. 2 has a first end 42 which may be formed with a hollow neck 44 having an outer threaded surface 46 configured to be complimentary threaded to the threaded internal surface 34 of a coupling collar 15. The wind guard chamber 40 is preferably of a sufficient inner diameter, for example 2 to 3 inches, to avoid contacting the discharged stream or spray of liquid chemical L along the spray path P. The length of the chamber 40 should preferably be long enough to allow the pressurized liquid chemical to impinge upon the diffuser screen as a stream of liquid chemical with sufficient force to provide a uniform circular pattern onto the targeted area, and permit a user to carry out use of the invention, for example, spraying weeds without having to unduly bend over in order to assure that liquid L hits the intended target. The length can be for example, a foot or so. A second end 48 of the chamber 40 can also be formed with an outer threaded surface 50 for purposes of attaching drip ring 52, diffuser screen 70 and windshield 90, elements to be further described herein.

The wind guard chamber 40 may be conveniently coupled to and removed from the applicator 10 using a connector such as an annular internally threaded collar 15 as depicted in FIG. 1. The illustrated exemplary collar 15 is generally hollow and has a first end 26 formed with an opening 28 which is slightly larger in diameter than the diameter of than a threaded end of the discharging jet 22 that secures the collar 15 to the pressure activated pump head 16. The male threaded end of the discharging jet 22 engages within a female threaded opening in a neck on the forward end of the pressure activated pump head 16. An inner open surface 30 formed within the first end 26 of the collar 15 is larger than a flanged head comprising the discharging jet 22 to accommodate housing the same. The collar 15 has a second end 32 that includes a female threaded internal surface 34 to engage male threaded surface 46 of neck 44 of the wind guard chamber 40. The collar end 32 is sized to permit access to the discharging jet 22 for connecting it to and disconnecting it from the pressure activated pump head 16, e.g., via a hex head profile or an Allen-hex or slot opening (not shown) comprising the flanged head of the discharging jet 22. The end 26 of the collar 15 may be thus secured to between the pressure activated pump head 16, locking in place the collar 15 for connecting the wind guard 40 to the applicator 10 by a hand tightened engagement.

Figure 3:
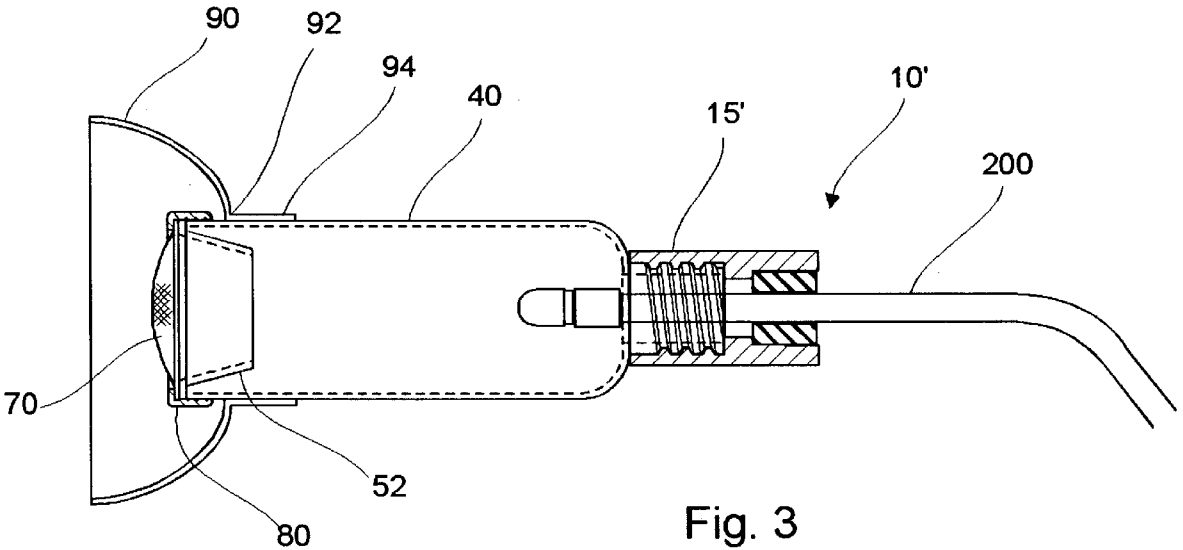
FIG. 3 is a cross-sectional view of another embodiment of the invention adapted for use, e.g., as part of a wand type applicator.
Figures 2, 2A, 2B, 2C, 2D, 2E, 2F:
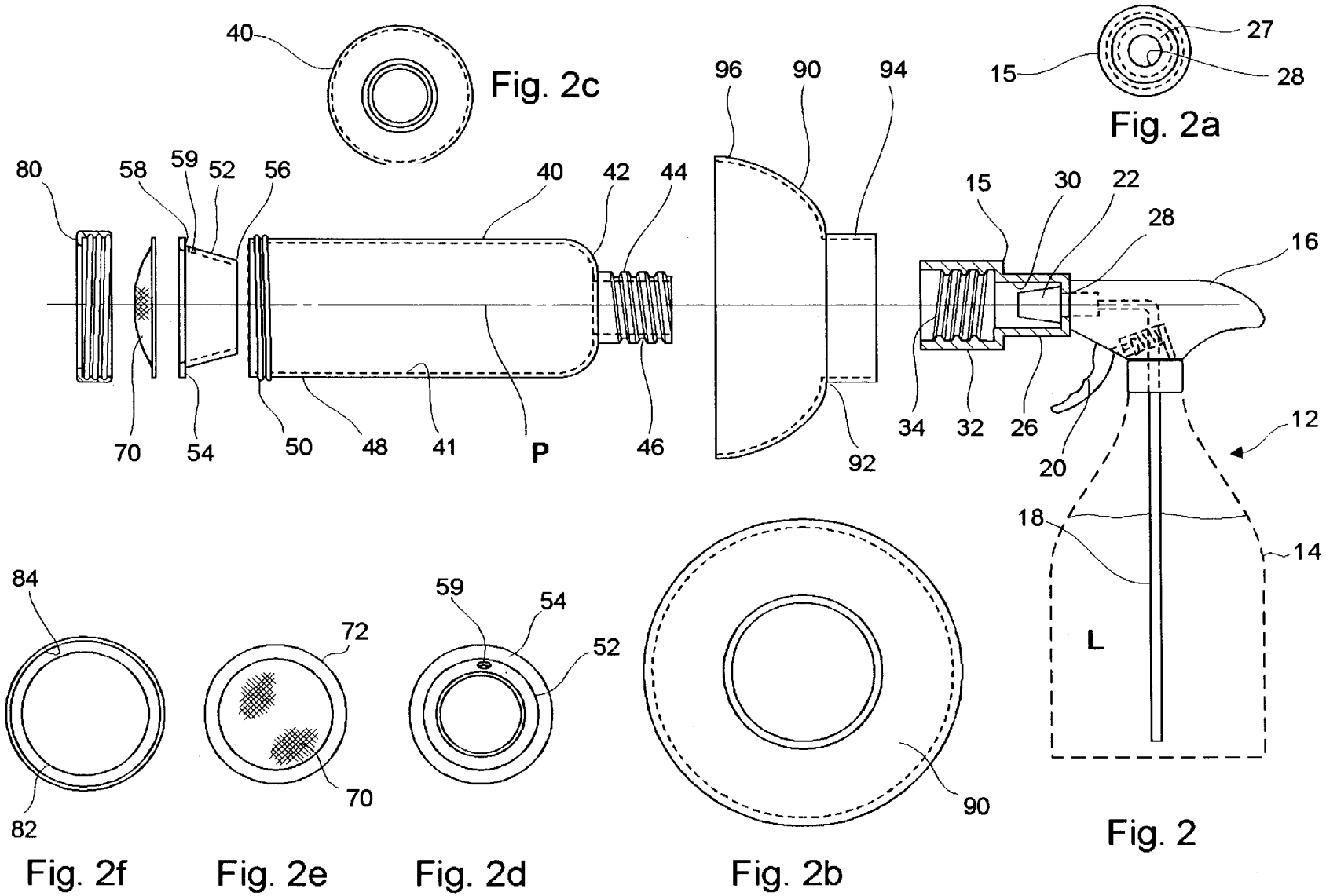
FIG. 2 is an exploded view of the embodiment in FIG. 1.
FIG. 2*a* is an end view of a part (connecting collar 15) of the embodiment in FIG. 1.
FIG. 2*b* is an end view of another part (windshield 90) of the embodiment in FIG. 1.
FIG. 2*c* is an end view of still another part (wind guard chamber 40) of the embodiment in FIG. 1.
FIG. 2*d* is an end view of yet another part (drip ring 52) of the embodiment in FIG. 1.
FIG. 2*e* is an end view of another part (diffuser screen 70) of the embodiment in FIG. 1.
FIG. 2*f* is an end view of again another part (cap ring 80) of the embodiment in FIG. 1.
Figure 17:
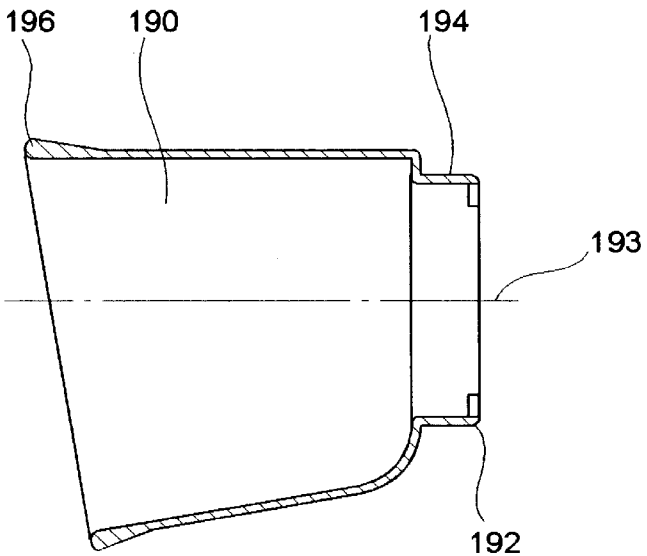
FIG. 17 is a cross-sectional view of the windshield of FIG. 16 through line 17—17.
Figure 16:
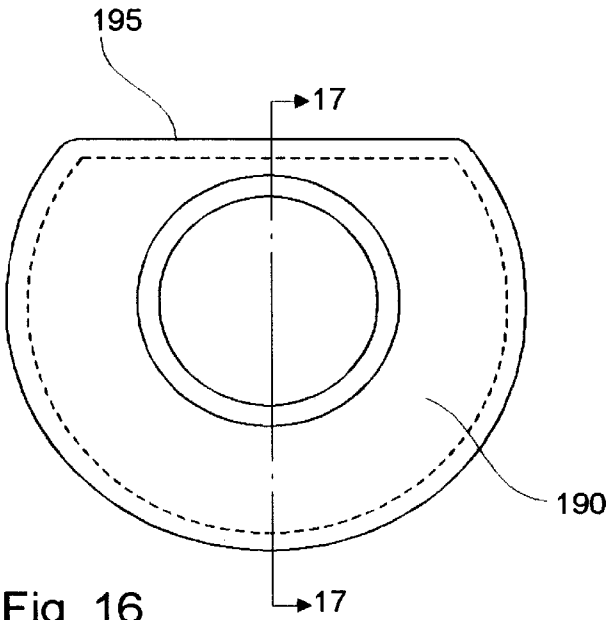
FIG. 16 is an end view of a windshield of another embodiment of the invention.
Figure 18:
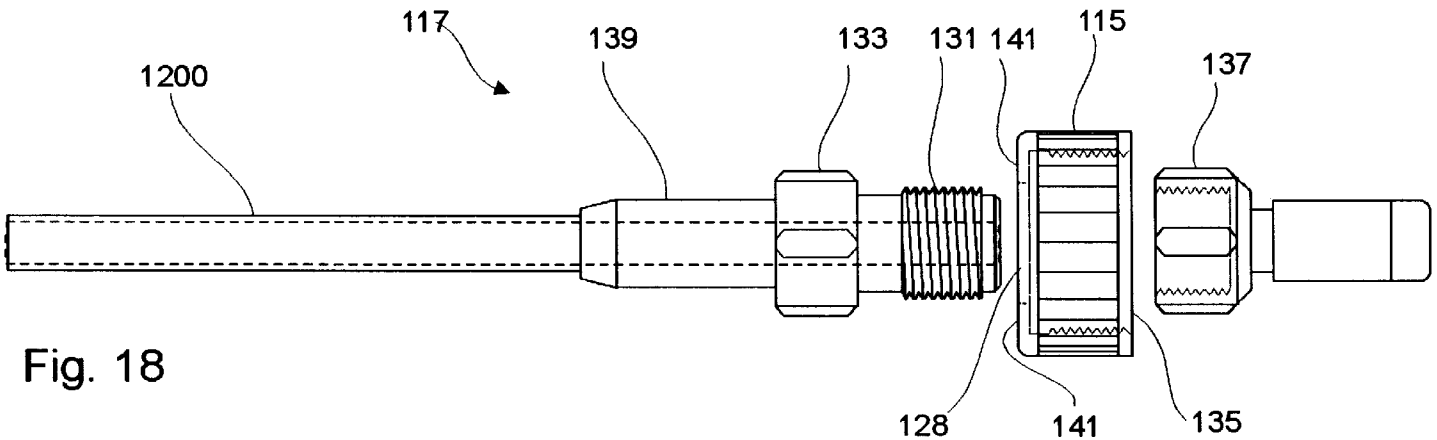
FIG. 18 is an exploded view of an adapter for use with chamber 40.

In another embodiment of the present invention as shown in FIGS. 16 through 18, a wind guard chamber exemplified, e.g., by numeral 40 in FIGS. 1, 2 and 3 is coupled to and removed from assembly 117 using an annularly internally threaded cap 115 as illustrated in FIG. 18. The cap 115 is generally hollow and has a first open surface 128 which is slightly larger in diameter than the male threaded end 131 of adaptor 139 and slightly smaller than shoulder stop 133, and a second open surface 135 which is slightly larger than threaded nozzle cap 137. The second open surface 135 exhibits an annularly internally threaded surface 143 extending through the cap 115 to an annular lip 141 which includes open surface 128.

The cap 115 slides over threaded end 131 and abuts shoulder stop 133. The threaded nozzle cap 137 engages threaded end 131 to secure cap 115 against shoulder stop 133 against movement and may be any fixed means which secures the cap 115. Here, the shoulder stop 133 may be a fixed annular extension of the adaptor 139 and having an outer diameter greater than the outer diameter of adaptor 139. Optionally, the shoulder stop 133 may consist of one or more protrusions on the outer surface of adaptor 139. Alternatively, the shoulder stop 133 may be a tightening element such as a nut wherein the nut engages the threaded end 131 of adaptor 139 and cooperates with threaded nozzle cap 137 to secure cap 115 to the adaptor 139. A wind guard chamber (not shown), but illustrated in FIGS. 1 through 3 and described elsewhere in the description, is threadedly secured to and removed from the assembly 117 easily and rapidly without disassembling the assembly 117.

A windshield 190 as shown in FIG. 17 may be provided on the distal end of the wind guard chamber as depicted in FIGS. 1, 2 and 3, for example. As described earlier the windshield 190 has a tubular shaped sleeve 194 extending from one end of the windshield 190. The inner diameter of the sleeve 194 is sized to enable the sleeve 194 to be slidably disposed about the distal end of the wind guard chamber and frictionally retained on the wind guard chamber as shown in FIGS. 1, 2 and 3. As discussed supra, the windshield 190 is depicted in one embodiment of the invention wherein at least a portion of the windshield 190 exhibits a substantially flat surface 195. Typically, the flat surface 195 is laterally disposed from a central longitudinal axis 193 of the windshield 190.

The windshield 190 may be affixed to the end of the chamber in a manner such that the position of the flat surface 195 of the windshield 190 is at any desired orientation or angle to provide a desired spray pattern. The flat surface 195 provides a truncated cylindrical opening 196 which may be flared.

A drip ring 52 may be generally frustoconical shaped and may include an annular sealing lip 54 and is best illustrated in FIGS. 1. 2, and 2*d*. The illustrated exemplary drip ring 52 has an end 56 of sufficient smaller diameter than a diameter of inner surface 41 of the chamber 40 such that a reservoir space 57 is formed therebetween. Another end 58 of the illustrated drip ring 52 is larger in diameter than the drip ring end 56, but slightly smaller than the diameter of inner surface 41 of the chamber 40. The sealing lip 54 extends radially outward from the drip ring end 58 and is approximately equal in diameter to the end 48 of the chamber 40 to seat against the chamber end 48 to form a seal therebetween. As shown, the reservoir space 57 is defined by an outer surface 60 of the ring 52 and a portion of the inner surface 41 adjacent chamber end 48.

A drain 59 may extend through the drip ring 52 preferably near the end 58. The drain 59 is preferably positioned at the top of the wind guard chamber 40 when connected to the bottle 12 as seen in FIG. 1. In this way, the excess liquid L in the reservoir space 57 can be emptied therefrom when tilting the wind guard chamber 40 in a downward direction allowing liquid L to travel out of the drain 59 onto an arcuate diffuser screen 70 hereinafter described. This permits emptying of excess liquid L at a safe location where emptied chemicals can be recovered or otherwise do no harm.

An exemplary arcuate diffuser screen or mesh 70 is best illustrated in FIGS. 1, 2, and 2*e*, for example. The diffuser screen 70 is illustrated as having a diameter approximately that of the sealing lip 54 and as including a portion 72 which seats against the drip ring sealing lip 54. The diffuser screen 70 is designed with a mesh opening size to enable dispersion of the liquid chemical L received from the discharging jet 22 along path P, as seen in FIG. 1. It is to be understood that the mesh opening size is sized to achieve a desired dispersion, and that ideal sizing may vary according to ambient outside conditions and the chemicals used. Hence, it may be advantageous to employ a variable effective mesh size diffuser screen to accommodate a variety of chemicals and conditions. Such a device may, for example, be constructed using a stacked pair of finely slotted disks that can be rotated with respect to one another to make effective screen size adjustments. Alternatively, different mesh size accessory diffuser screens may be provided and alternately used as desired. Ready ability to install and remove accessory screens may thus be a desired implementation feature for diffuser screen interchange as well as for general serviceability of the parts. The effect achieved via the diffuser screen 70 can be important in that it permits a more uniform application of the liquid chemical L targeted vegetation whereby the vegetation is substantially able to be covered with the liquid chemical L by an economical and efficient spray pattern. Preferably, the pressurized stream of liquid chemical from the activated pump head impinges upon a central region of the diffuser screen to provide a uniform circular pattern of dispersed chemical to the target area. The surface area and mesh size of the diffuser screen 70 are preferably such as to catch and maintain drips from the discharging jet 22 and prevent dripping liquid chemical L when moving from one plant to the next plant.

An exemplary annular cap ring 80 is best illustrated in FIGS. 1, 2, and 2*f*, for example, and may be used to hold the diffuser screen 70 and drip ring 52 in place against the wind guard chamber 40. The cap ring 80 may include a radially inwardly extending lip portion 82 to retain the parts. An inner surface 84 of the cap ring 80 may be threaded in a complementary manner to connect to threaded surface 50 of chamber 40.

Additionally, a windshield 90 may be provided, e.g., as depicted in FIGS. 1, 2, and 2*b*, for example. The illustrated arcuate windshield 90 has a first end 92 configured with a sleeve 94 having an inner diameter sized to enable it to be frictionably slidably disposed about the chamber 40 and retained from sliding off the second end 48 by the cap ring 80. Second end 96 of the windshield 90 may be flared or have a substantially widened radius with respect to a radius of the end 48 of chamber 40 to permit the dispersed spray to reach the intended target area while shielding the same from wind, e.g, as seen in FIG. 1.

As illustrated in FIGS. 16 and 17, the flat surface 195 of the windguard 190 is operationally oriented in a parallel relationship to the object against which the vegetation to be sprayed is growing. This allows the liquid spray to be more effectively delivered from the applicator to vegetation growing, e.g., along side a building foundation, wall, fence row, etc. in that the spray pattern of the liquid is efficiently directed from the wind guard 190 onto the vegetation growing in such areas. Typically, the flat surface 195 of the wind guard 190 is laterally disposed from the central axis 193 with respect to the handle of the applicator, however, the wind guard 190 may be affixed to the end of the applicator so that the orientation of the wind guard 190 is at any desired angle to provide the most efficient spray pattern.

Figure 3C:
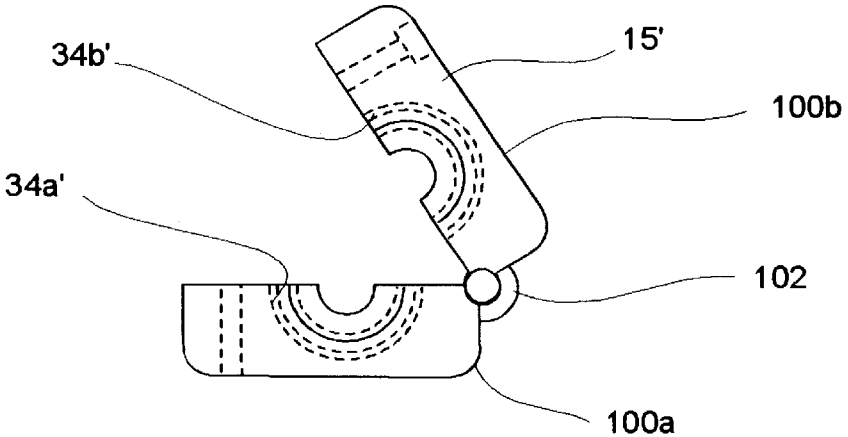
FIG. 3*c* is an end view of the part (collar 15') in FIG. 3*a* in an open position.
Figure 3B:
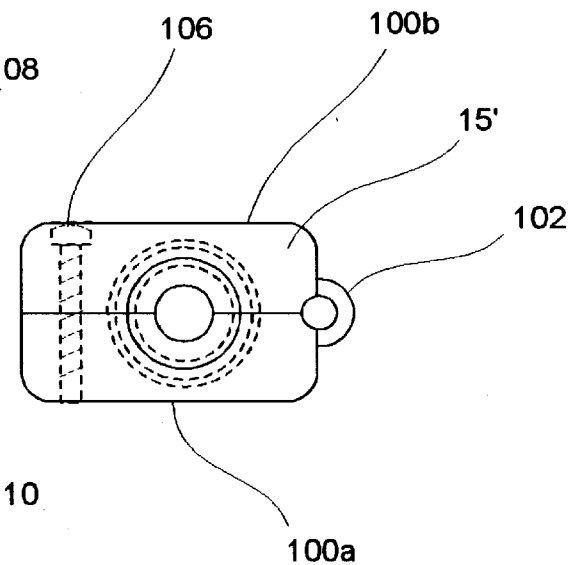
FIG. 3*b* is an end view of the part (collar 15') in FIG. 3*a*.
Figure 3A:
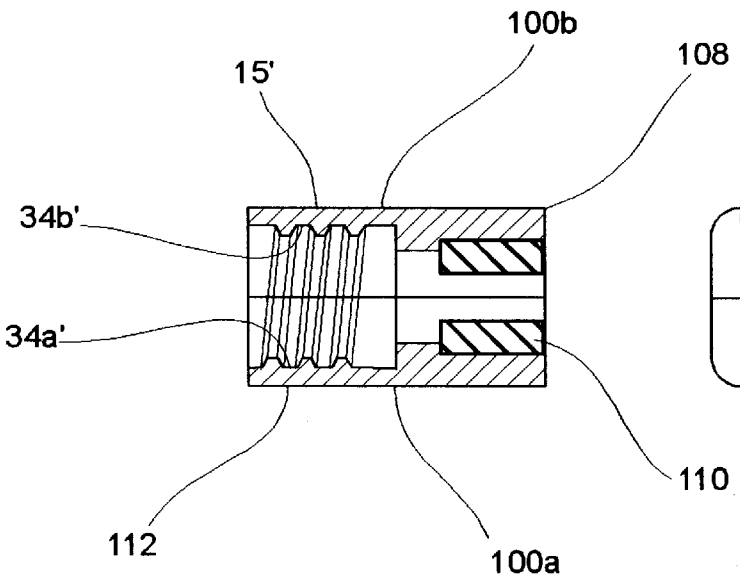
FIG. 3*a* is a cross sectional view of a part (collar 15') of the embodiment in FIG. 3.
Figure 3D:
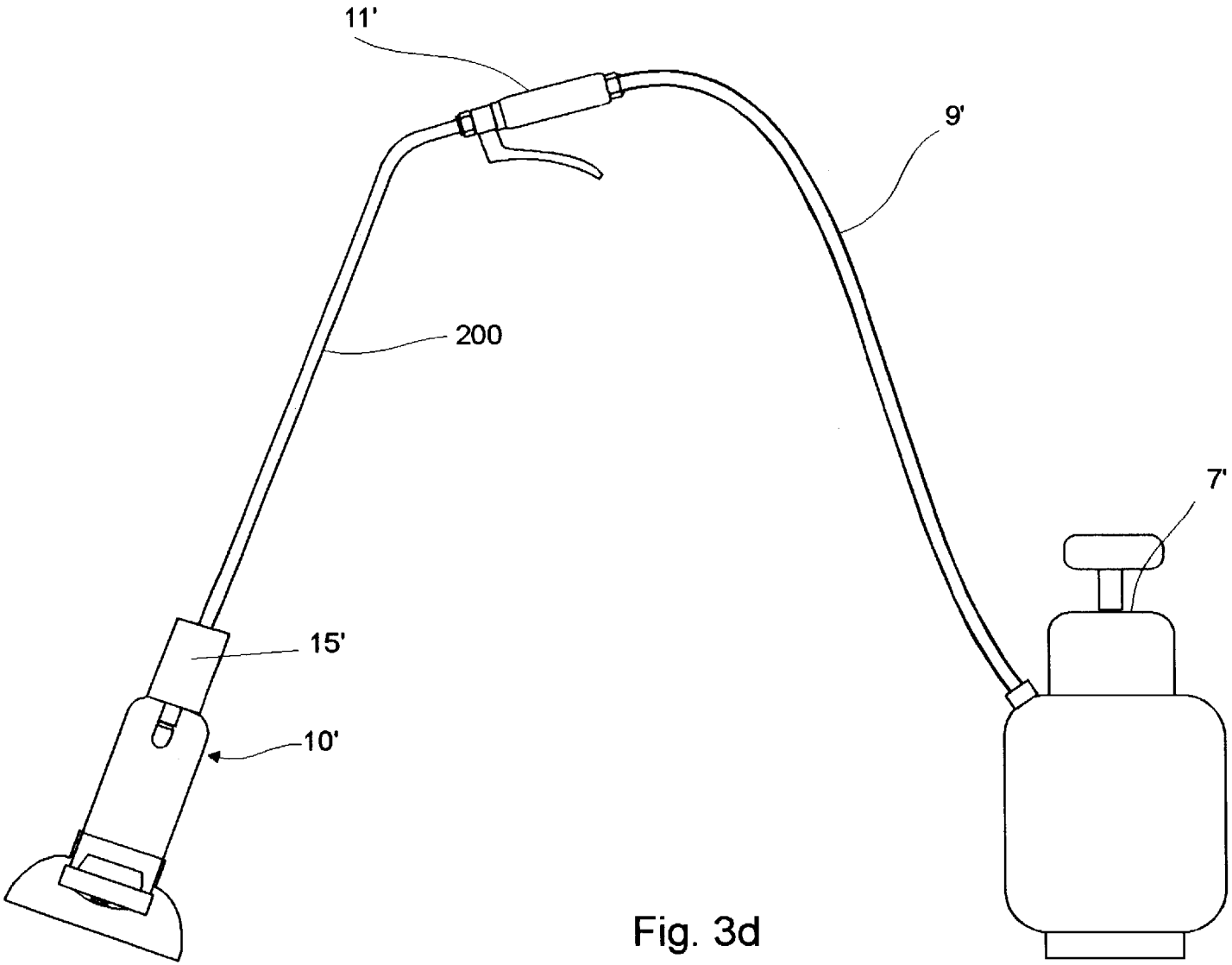
FIG. 3*d* depicts the embodiment of FIG. 3 connected to a conventional liquid pressure tank.

Depicted in FIGS. 3 and 3*d* is an alternative embodiment 10' for use on a fluid extension conduit or wand 200. Here, the illustrated applicator 10' incorporates an alternative exemplary collar 15' shown in FIGS. 3, 3*a–d*. FIG. 3*d* shows the embodiment 10' connected to a conventional liquid pressure tank 7' via a pressure hose 9' and squeeze trigger handle 11'. The collar 15' may comprise two symmetrical halves 100*a* and 100*b* which are hingedly connected at one side by an integral flexible plastic hinge 102. The two halves of the collar 15' may respectively include complementary female threaded surfaces 34'*a* and 34'*b*. A retaining screw 106 can be threaded into the collar 15' in the closed position as seen in FIG. 3*b*. One end 108 of the collar 15' may include gripping collar pads 110, in the form of a rubber washer, for example, disposed about the wand 200. The collar 15' has another end 112 through which the female threaded inner surfaces 34'*a* and 34'*b* may receive the male threaded surface 46 of neck 44 of the wind guard chamber 40.

Figure 4:
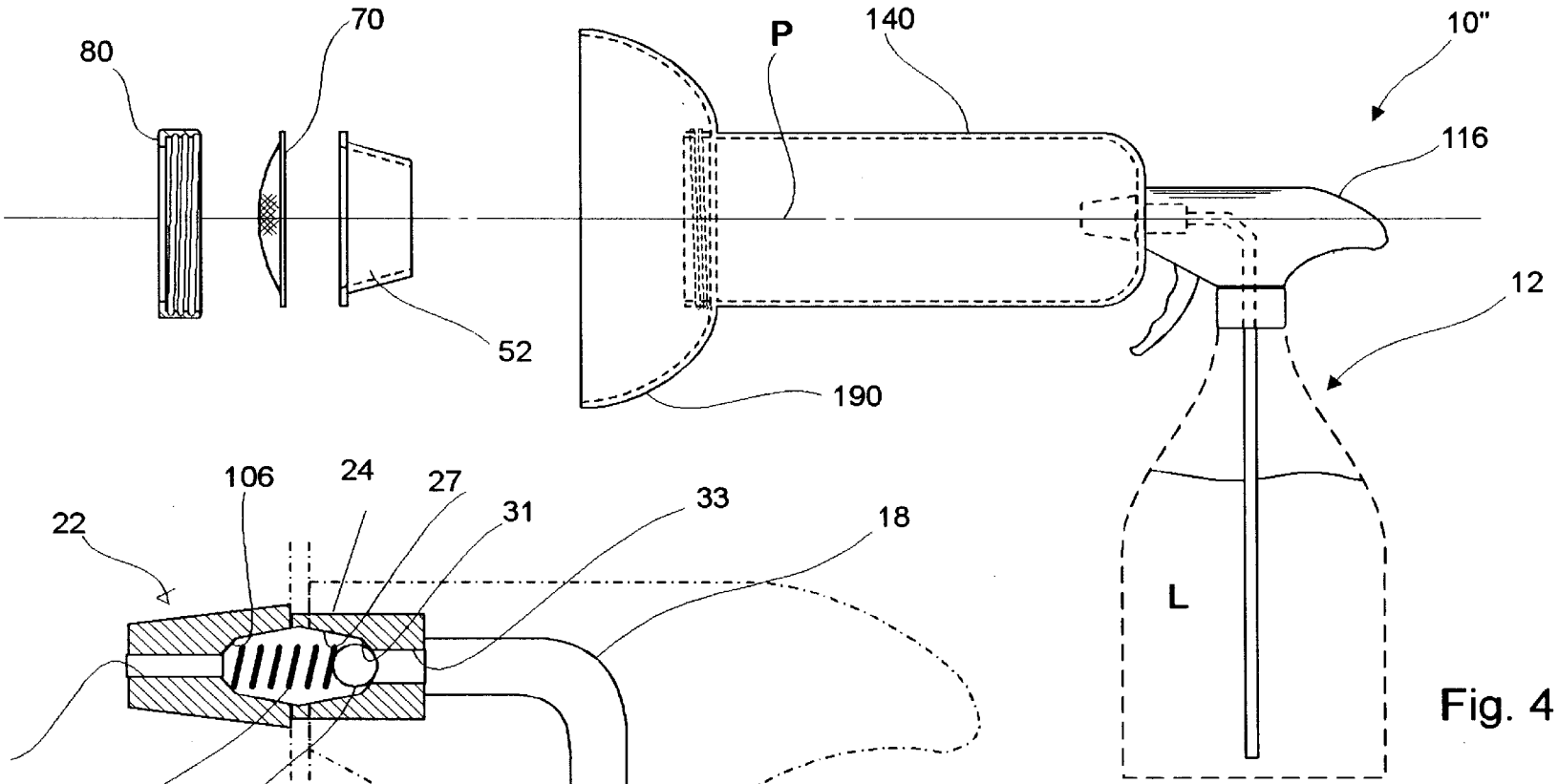
FIG. 4 is an exploded view of another embodiment of the invention with integrally formed elements.

FIG. 4 depicts another embodiment 10" having a substantially integrally formed wind guard chamber 140, windshield 190 and pump head 116. The pump head 116 may be threadably connectable to the bottle 12 and the chamber 140 may be connectable to parts 52, 70 and 80 as described above for the other embodiments.

Figure 6:
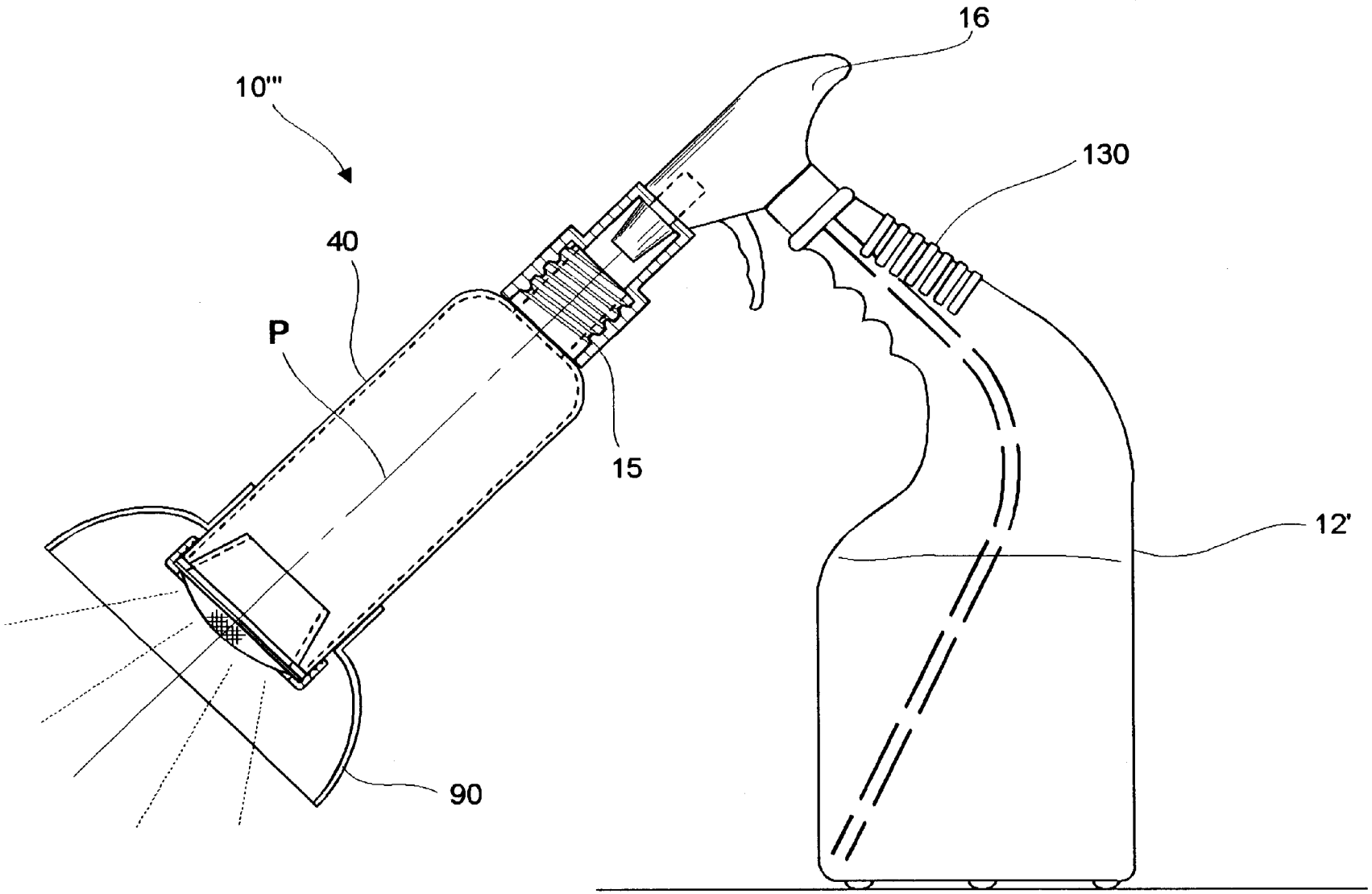
FIG. 6 is a cross-sectional view of another embodiment of the invention having an attached chemical reservoir bottle with an angled neck with gripping surfaces forming an integral handle.
Figure 7:
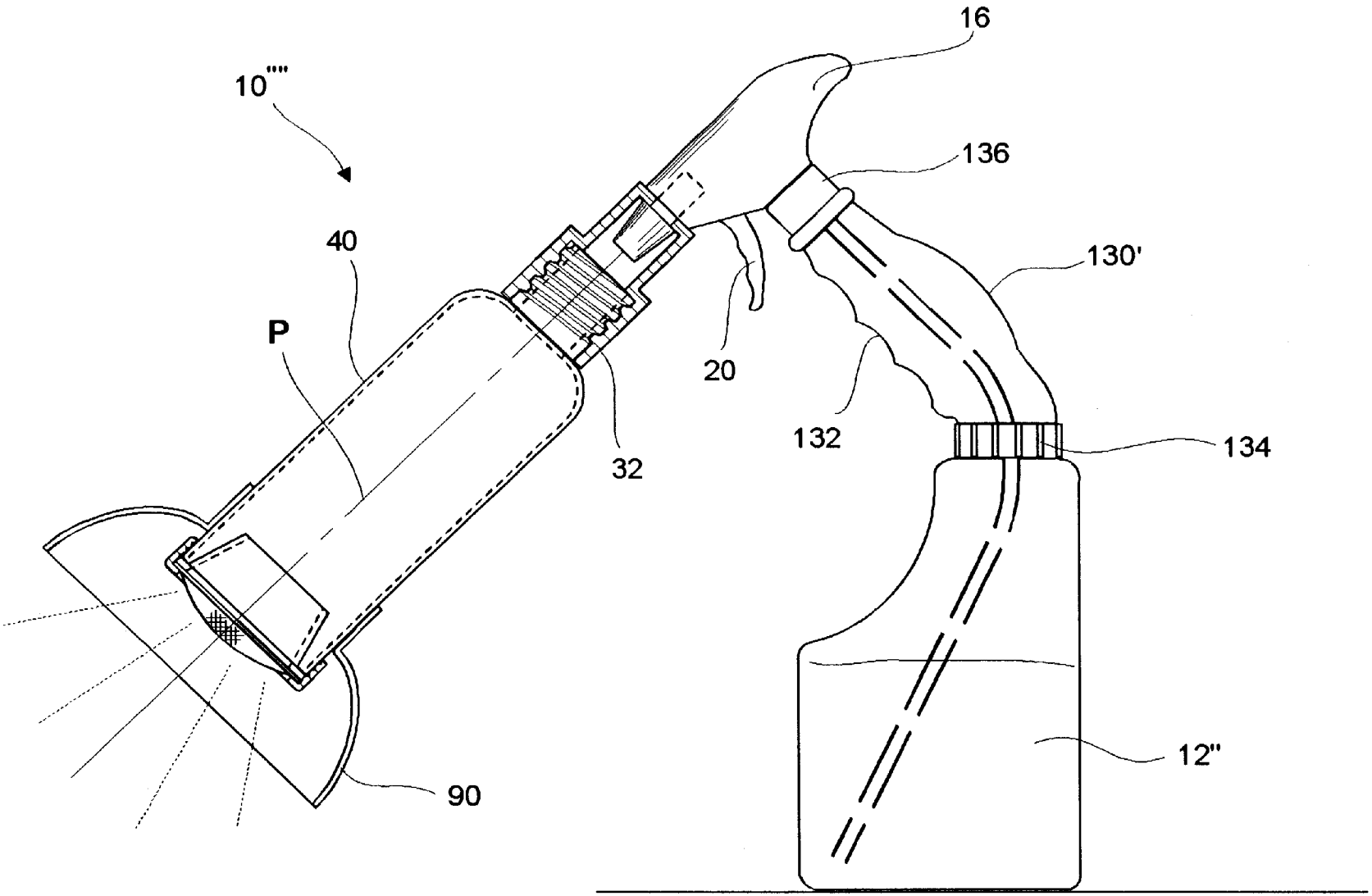
FIG. 7 is a cross-sectional view of the embodiment of FIG. 6 with an attached conventional chemical reservoir bottle and an angled connector neck with gripping surfaces forming a handle.

FIG. 6 exemplifies a preferred embodiment feature of the invention wherein an integrally formed bent handle 130 is incorporated in the chemical reservoir bottle 12' for applicator 10'''. FIG. 7 depicts another embodiment applicator 10'''' which differs from the embodiment in FIG. 6 in that there is provided a handle adapter 130' which may include a gripping surface 132' and connected universal chemical bottle 12". An end 134 of the handle adapter 130' includes a female inner threaded surface to thread to the neck of the bottle 12". Another end 136 of the adaptor 130' may have a male internal threaded surface for threaded connection to pump head 16. The illustrated handle adapter 130' incorporates a bend angle of about 45 degrees; however, other degrees of bend may also be suitable for aid in using the invention. The bend in the handle adapter 130' can provide the user a more comfortable operation due to a natural balancing of weight wherein the chemical bottle 12" hangs down by gravity while the path P remains focused on the intended ground target.

Figure 8:
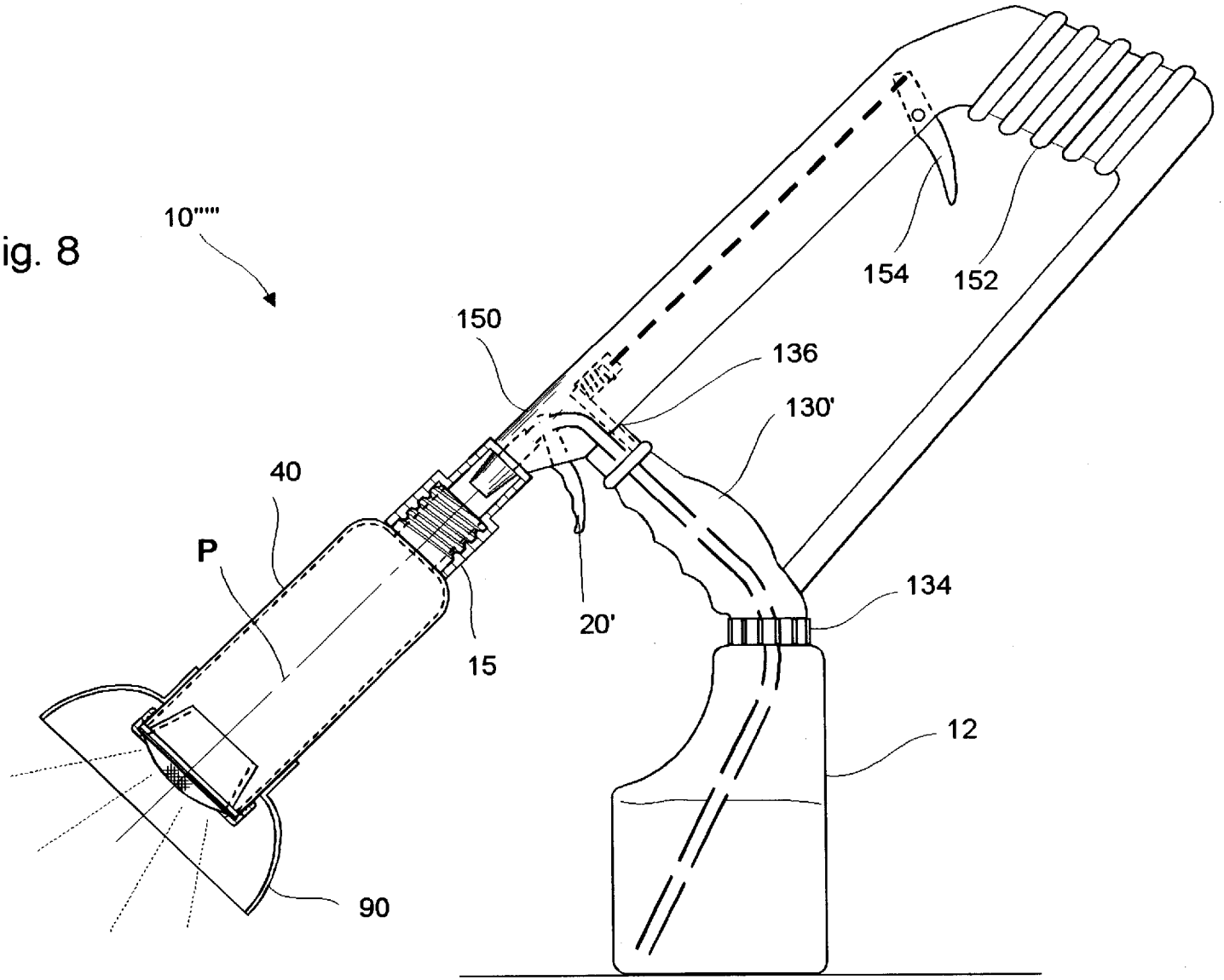
FIG. 8 shows a cross-sectional view of yet another embodiment of the invention having an extended bent handle assembly a bent handle adapter for connecting to a straight-necked chemical reservoir bottle.

FIG. 8 depicts another embodiment of an applicator 10''''' connected to the applicator handle adapter 130' and bottler 12". As further shown in FIG. 8, in the applicator embodiment 10''''', an elongated pump head 150 incorporates an integral handle 152 and an auxiliary a pump trigger 154 which are disposed rearwardly of the connection between the bottle 12" and the elongated pump head 150. The pump trigger 154 is operably connected to pump trigger 20' to enable pressurization.

Figure 9:
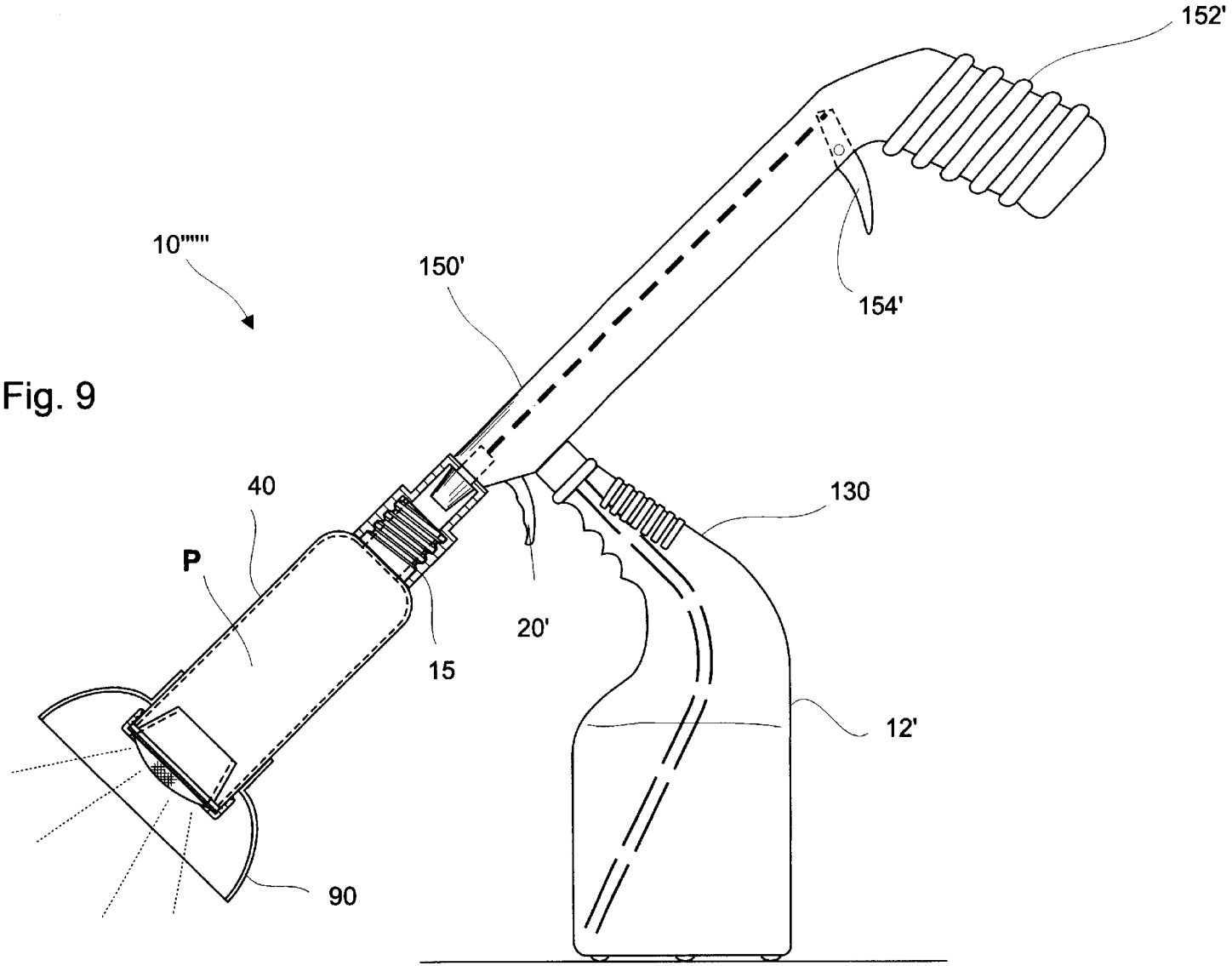
FIG. 9 shows a cross-sectional view of still another embodiment of the invention having an extended bent handle assembly and an attached chemical reservoir bottle with an angled neck with gripping surfaces forming an integral handle.

FIG. 9 illustrates applicator 10'''''', a further bent handle embodiment of the invention. FIG. 9 depicts the elongated pump head 150' with integrally formed rearward handle 152' and an integrally formed bent handle 130 in the reservoir bottle 12'. Similarly, the rearward handle 152' includes an auxiliary trigger 154'.

Figure 9A:
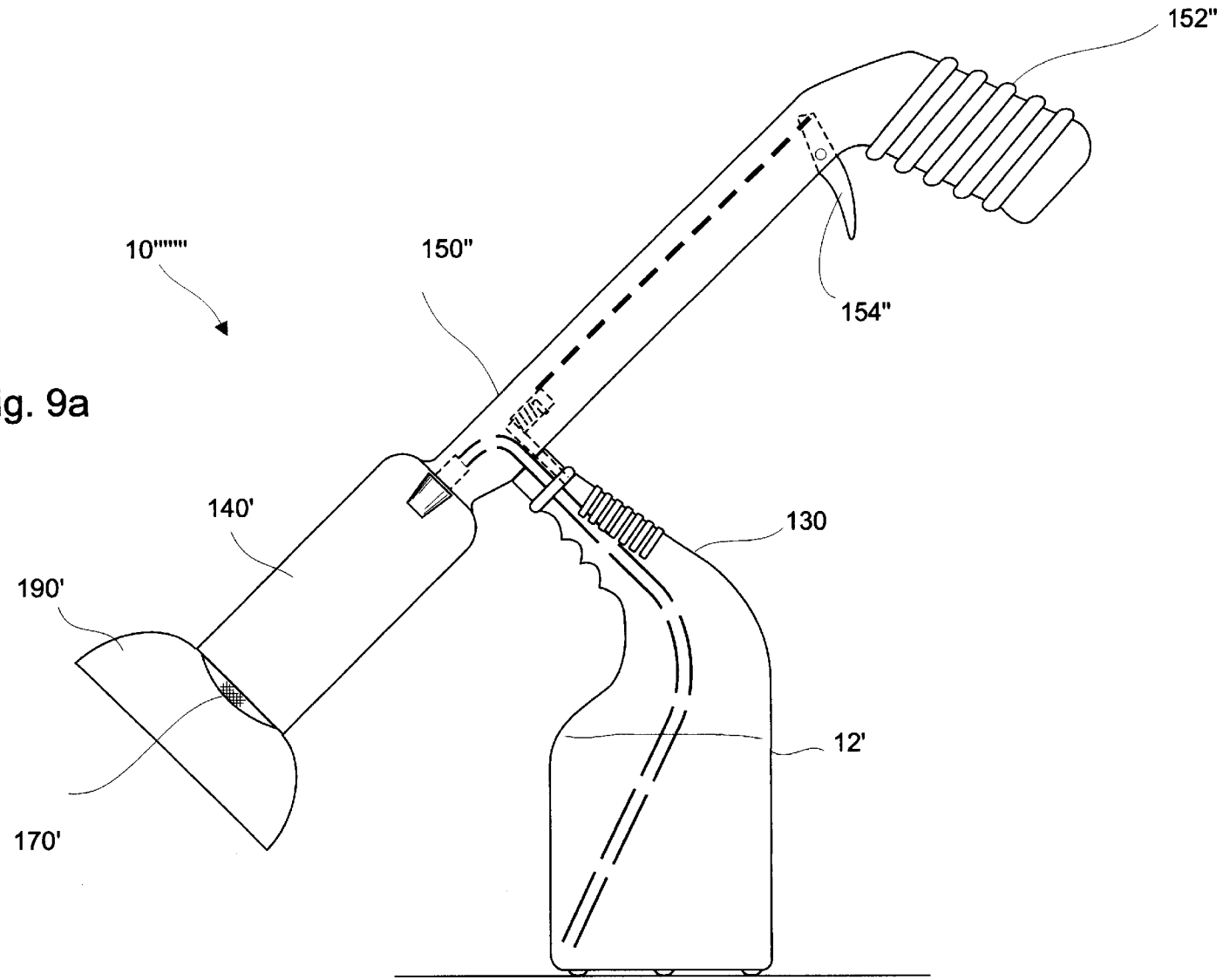
FIG. 9*a* shows a cross-sectional view of still another embodiment of the invention having an extended bent handle assembly and an attached chemical reservoir bottle with an angled neck with gripping surfaces forming all of which is integrally formed.

FIG. 9*a* illustrates applicator 10''''''', a further bent handle embodiment of the invention. FIG. 9*a* depicts the elongated pump head 150" integrally formed rearward handle 152", integrally formed wind shield 190', screen diffuser 170' and chamber 140' connected to an integrally formed bent handle 130' in the reservoir bottle 12'. Similarly, the rearward handle 152" includes a trigger 154" which is operably connected to the bottle 12'.

Figure 10:
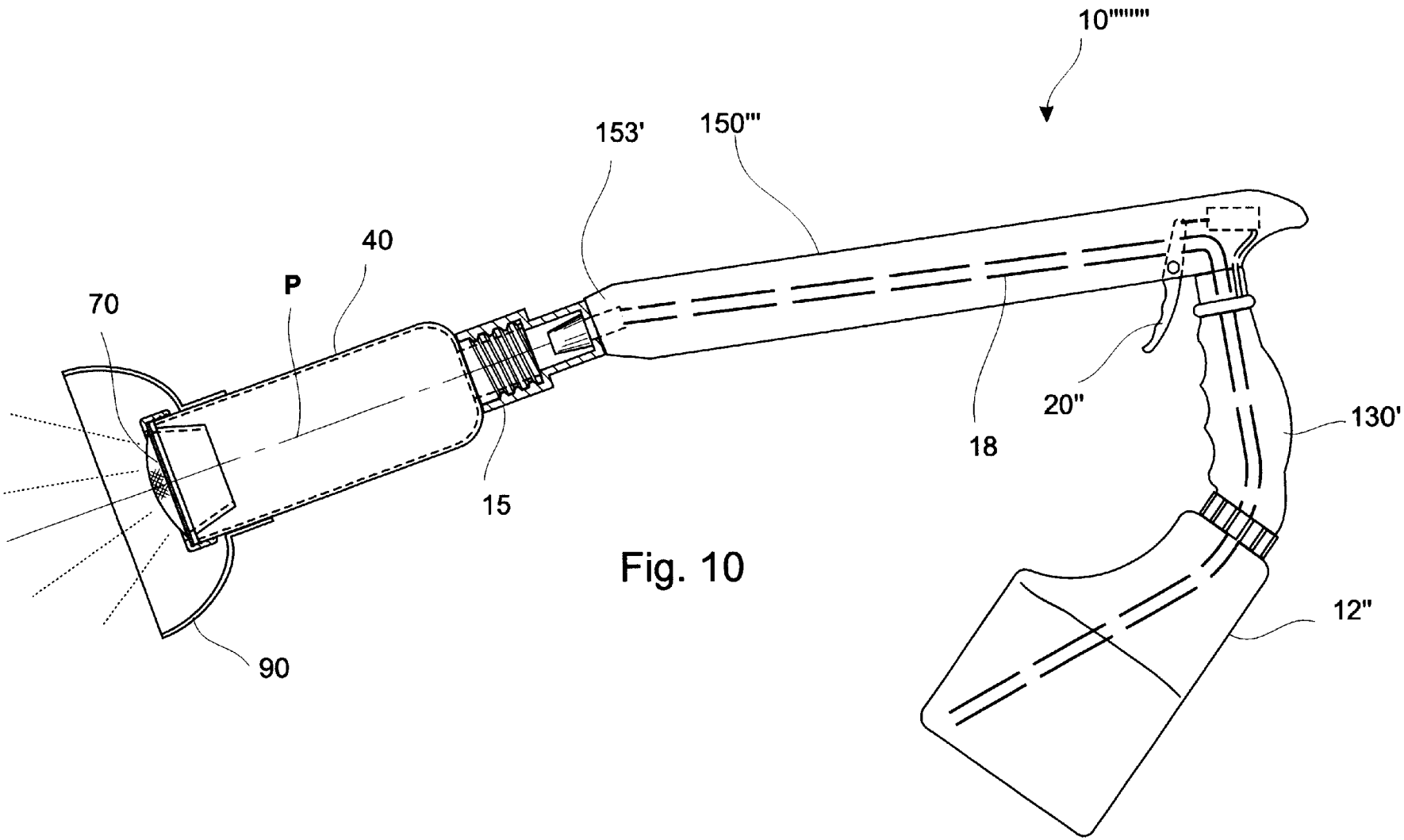
FIG. 10 shows a cross-sectional view of yet another embodiment of the invention having an extended bent handle assembly and an attached chemical reservoir bottle with an angled connector neck with gripping surfaces forming a handle.

FIG. 10 illustrates another applicator 10""", a further bent handle embodiment of the invention. FIG. 10 depicts the elongated pump head 150'", formed with a rearwardly disposed pump trigger 20", connected to bent handle adapter 130'and the reservoir bottle 12". Here, a forward end 153 of the pump head 150'" is formed in a manner to enable connection of the collar 15 and chamber 40 at an angle relative thereto.

Figure 11:
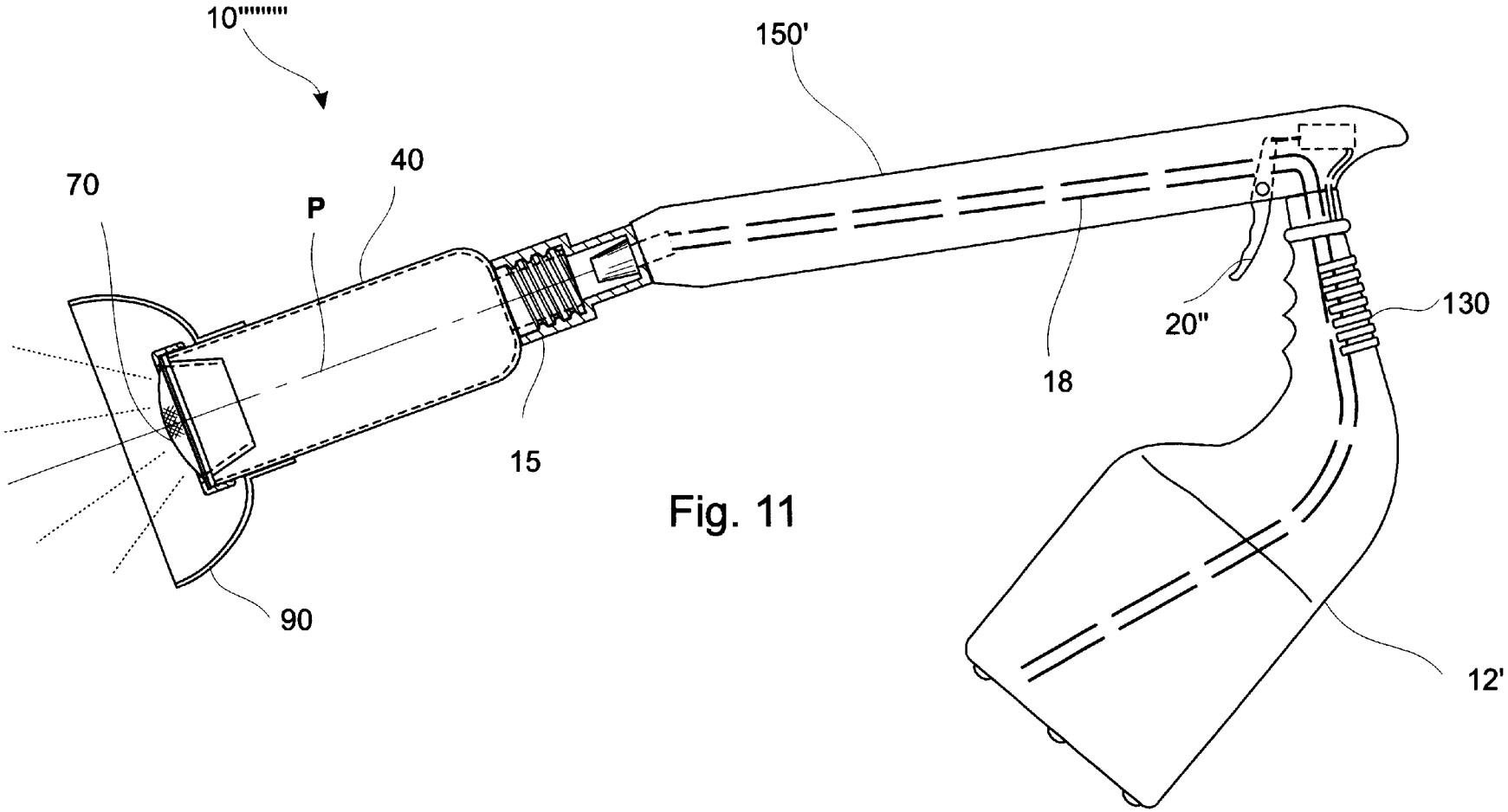
FIG. 11 shows a cross-sectional view of again still another embodiment of the invention having an extended bent handle assembly and an attached chemical reservoir bottle with an angled neck with gripping surfaces forming an integral handle.

FIG. 11 illustrates another applicator 10""", another bent handle embodiment of the invention. FIG. 11 depicts the elongated pump head 150'" as similarly shown in FIG. 10, connected to integrally formed bent handle adapter 130 and the reservoir bottle 12'. Here, a forward end 153 of the pump head 150'" is formed in a manner to enable connection of the collar 15 and chamber 40 at an angle relative thereto.

Figure 12:
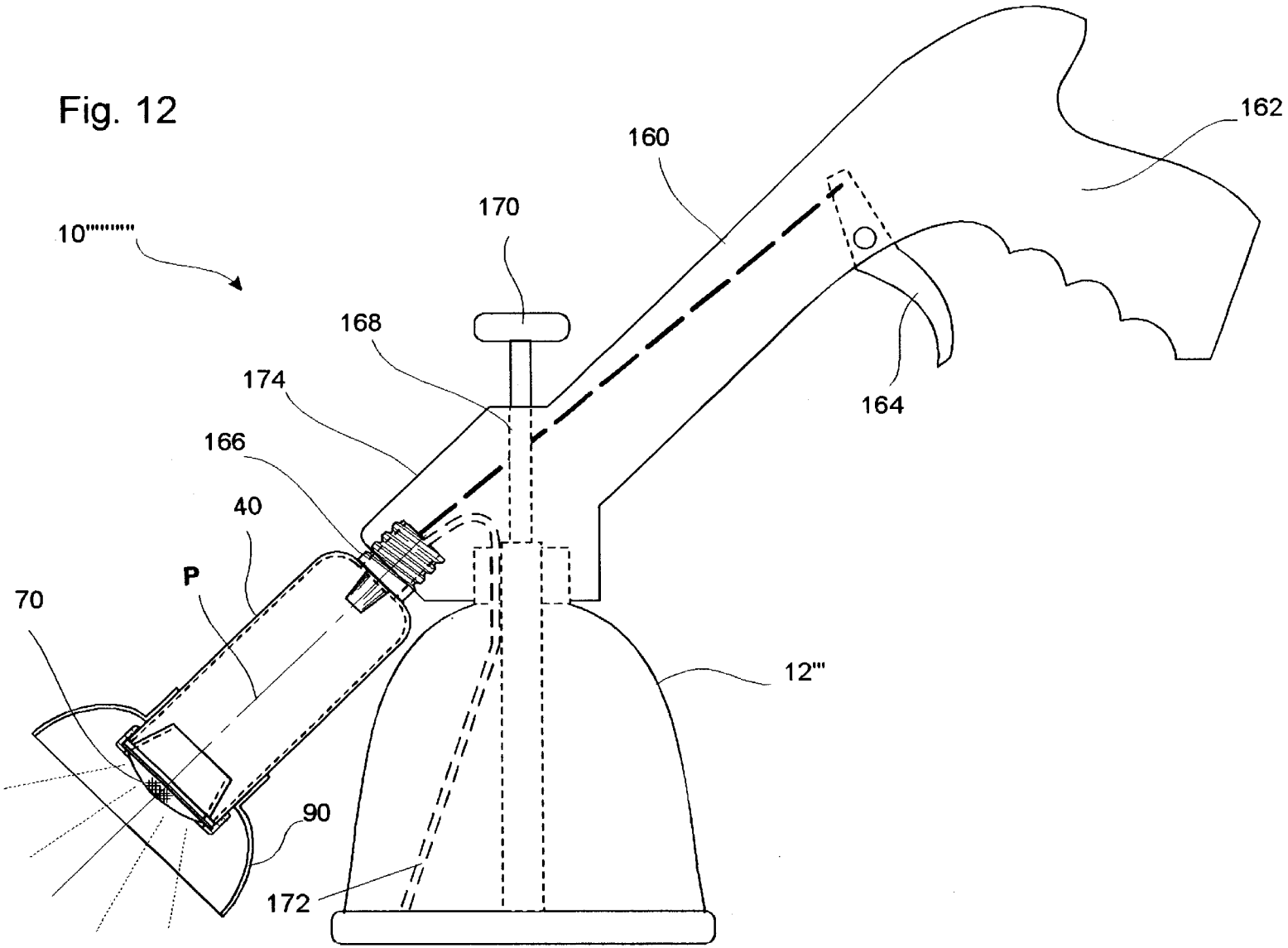
FIG. 12 shows a cross-sectional view of still another embodiment of the invention having an extended handle assembly and an attached chemical pump reservoir bottle.

FIG. 12 illustrates another applicator 10""" adapted for connection to a pump pressure tank 12'". Included is an elongated pump head 160 formed with a rearward handle 162 having a valve trigger 164 which may be connected to a release valve (not shown) in the pump head assembly 166. The pump head 160 may be formed with a suitable open surface 168 adjacent a connection of the tank 12'" to slidably receive a pump piston 170 there through. A feed line 172 communicably extends from the tank 12'"to pump head assembly 166. The pump piston 170 is used to achieve pressurization in the tank 12'"through reciprocation thereof. The tank 12'" is connected to the pump head 160 such that the same is at an angle and likewise a forward end 174 of the pump head 160 is formed in a manner to enable connection of the chamber 40 at an angle relative to the tank 12'".

Figure 13:
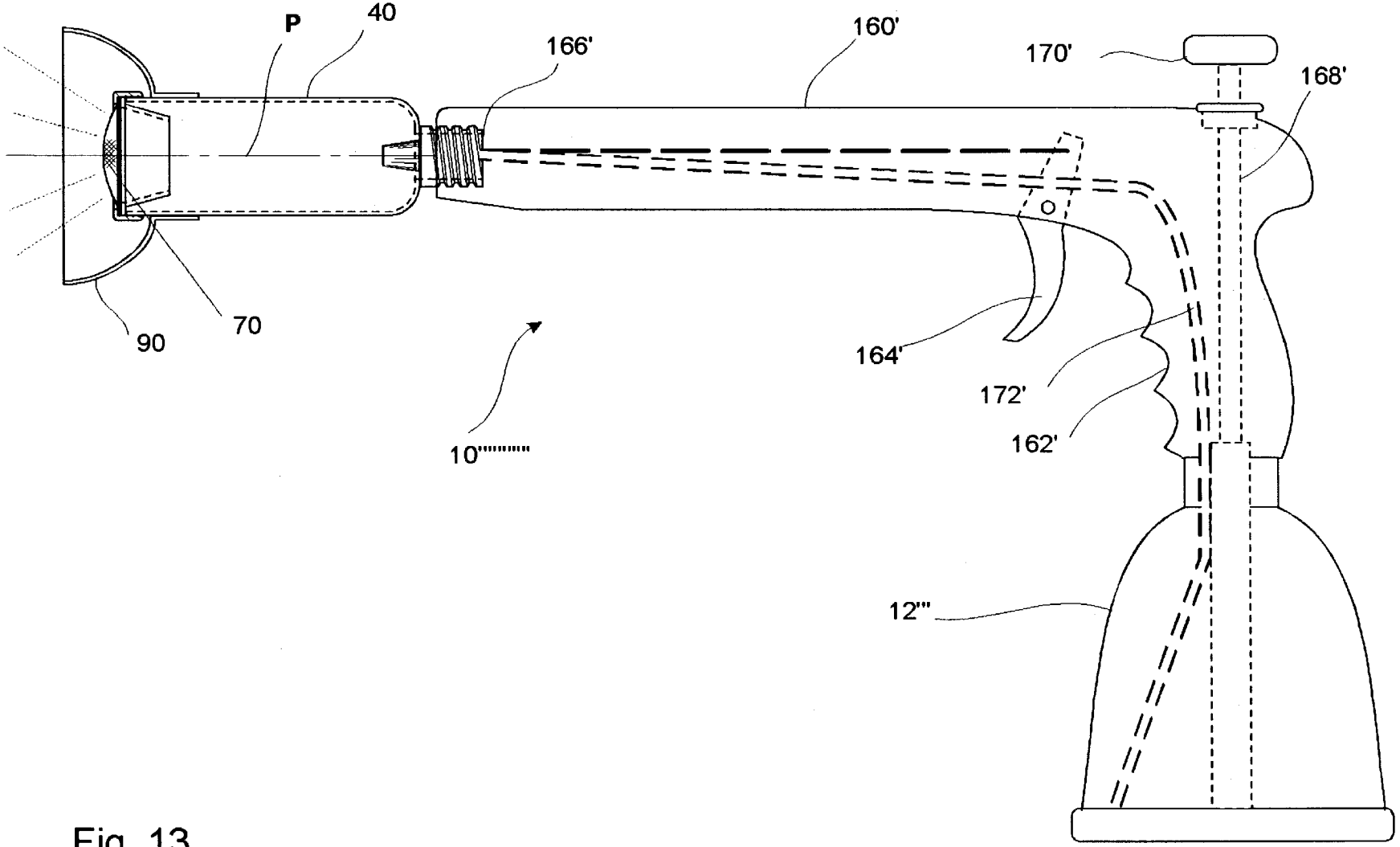
FIG. 13 shows a cross-sectional view of yet another embodiment of the invention having an extended handle assembly and an attached chemical pump reservoir bottle.

FIG. 13 illustrates another applicator 10"""" adapted for connection to a pump pressure tank 12'". Included is an elongated pump head 160' formed with a rearward handle 162' having a valve trigger 164' which may be connected to a release valve (not shown) in the pump head assembly 166'. Here, the pump head 160' may be formed with a suitable open surface 168' through the handle 162' adjacent a handle connection to the tank 12'" to slidably receive pump piston 170' therethrough. A feed line 172' communicably extends from the tank 12'" to pump head assembly 166'.

Figure 14:
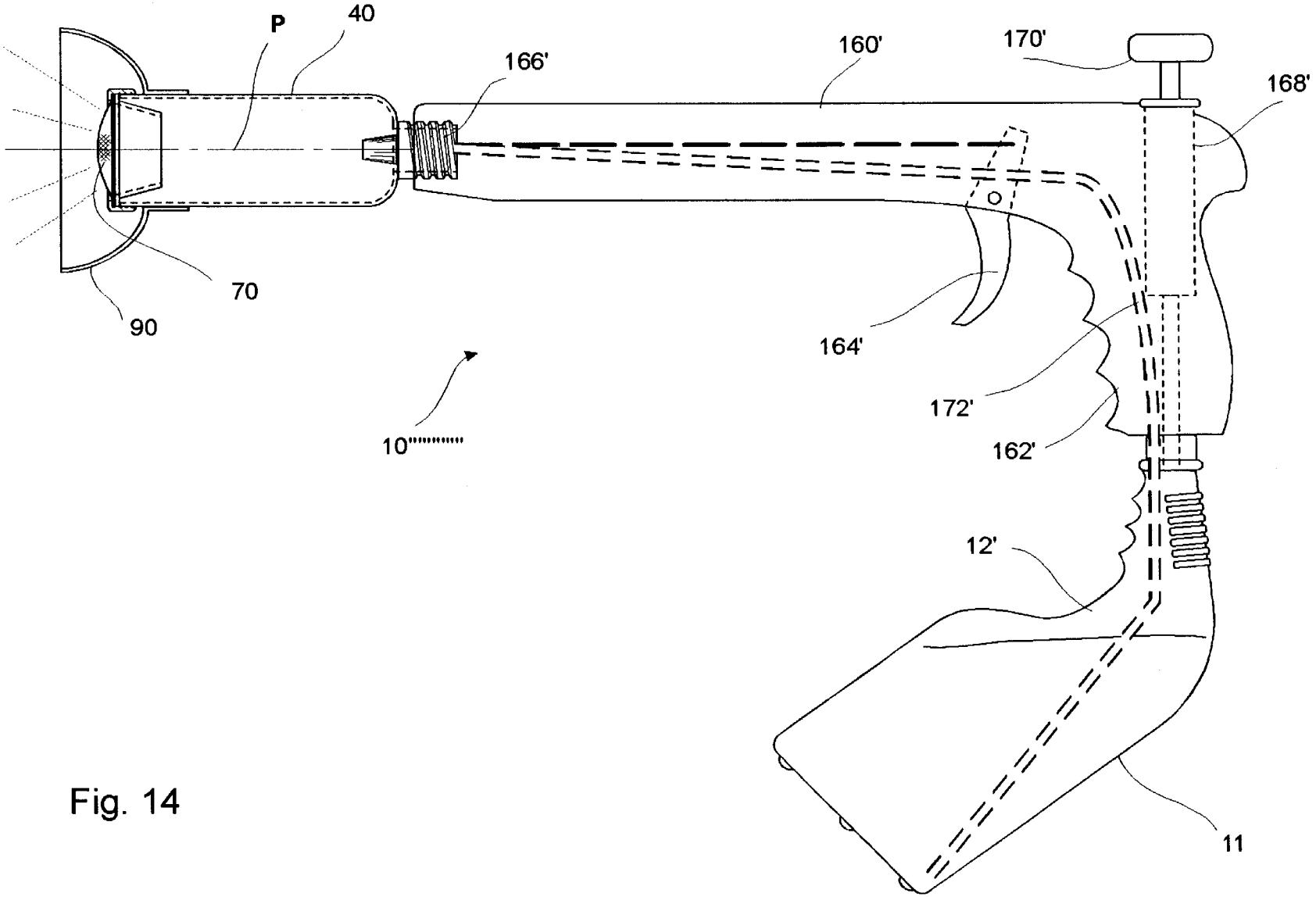
FIG. 14 shows a cross-sectional view of again another embodiment of the invention having an extended handle assembly and an attached pump attached to a chemical reservoir bottle.
Figure 15:
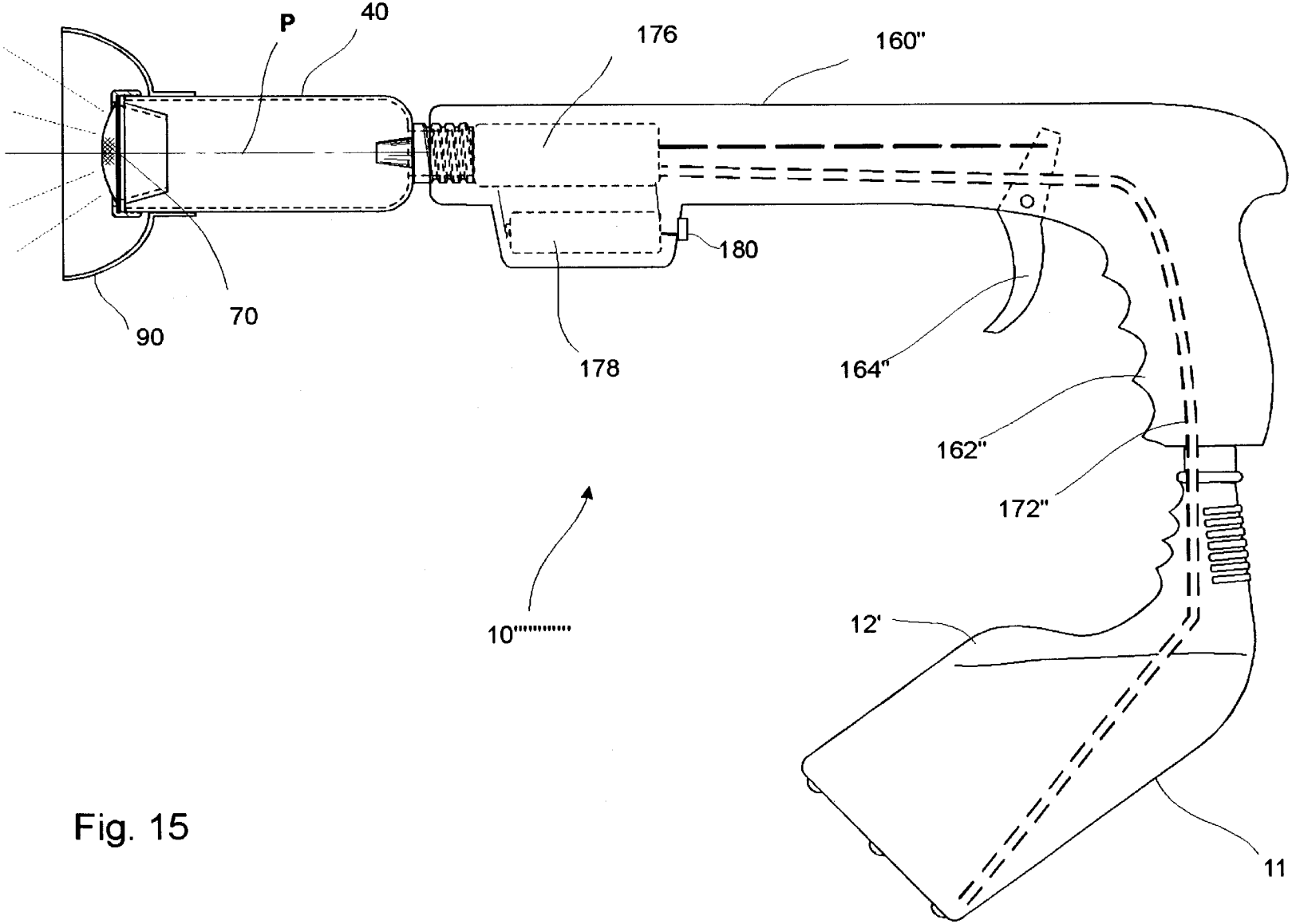
FIG. 15 shows a cross-sectional view of still another embodiment of the invention having an extended handle assembly and an attached battery operated pump attached to a chemical reservoir bottle.

FIG. 14 shows another applicator 10""""" which differs from that of FIG. 13 in the tank 12'. FIG. 15 shows still another applicator 10"""""" which differs from that shown in FIG. 14 in that the elongated pump head 160" includes an compressor 176 which is powered by a battery 178, for example, and equipped with a suitable switch 180.

Figure 19:
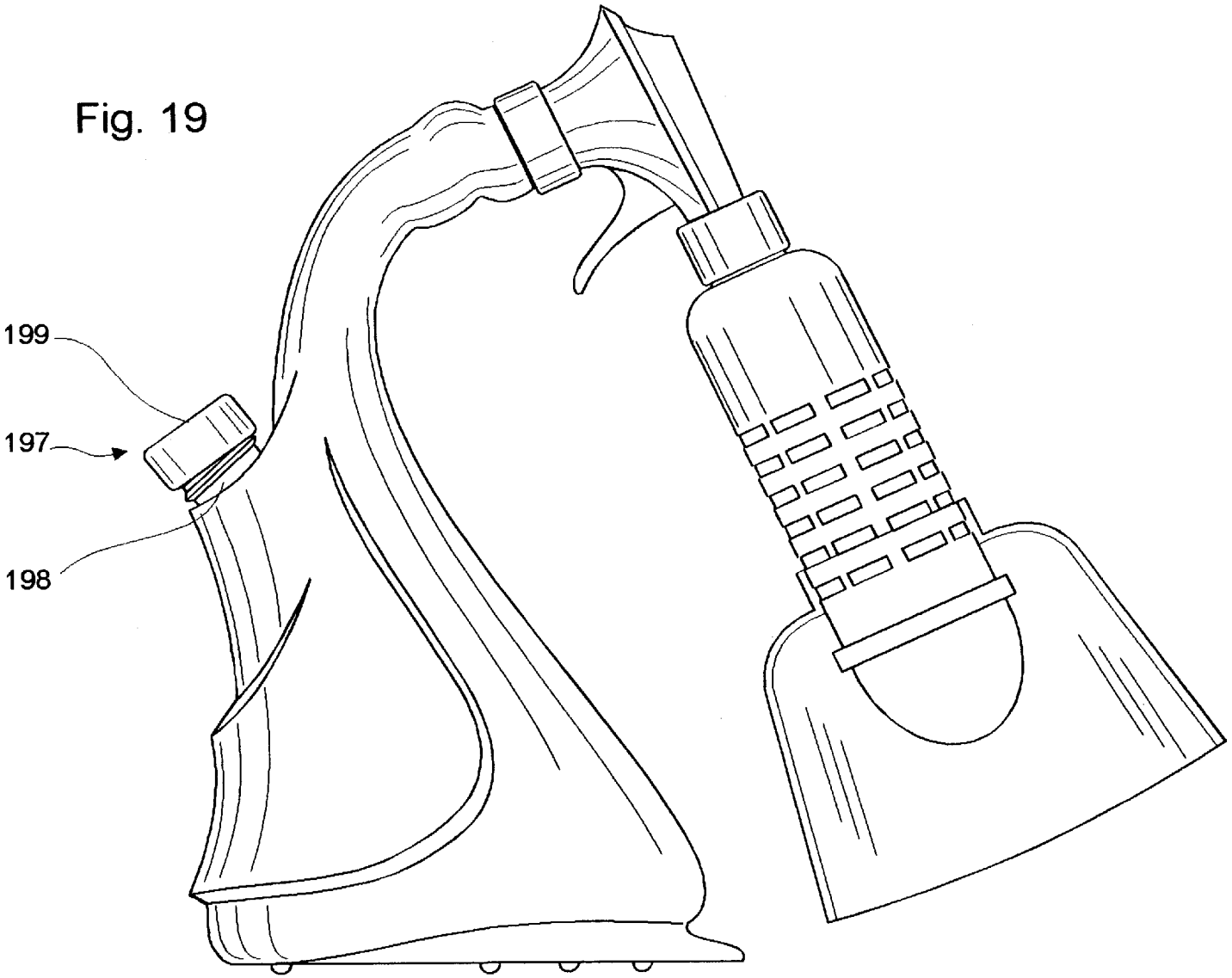
FIG. 19 illustrates a side view of another embodiment of the invention showing a separate port for filling the chemical reservoir bottle with the liquid chemical.

FIG. 19 illustrates yet another applicator which includes a separate refill port surface 197 for filling the bottle. The port includes a neck 198 which is externally threaded at its distal end for mailing with an internally threaded cap 199. The refill port surface 197 allows the bottle to be filled without disassembling the applicator.

Figure 20:
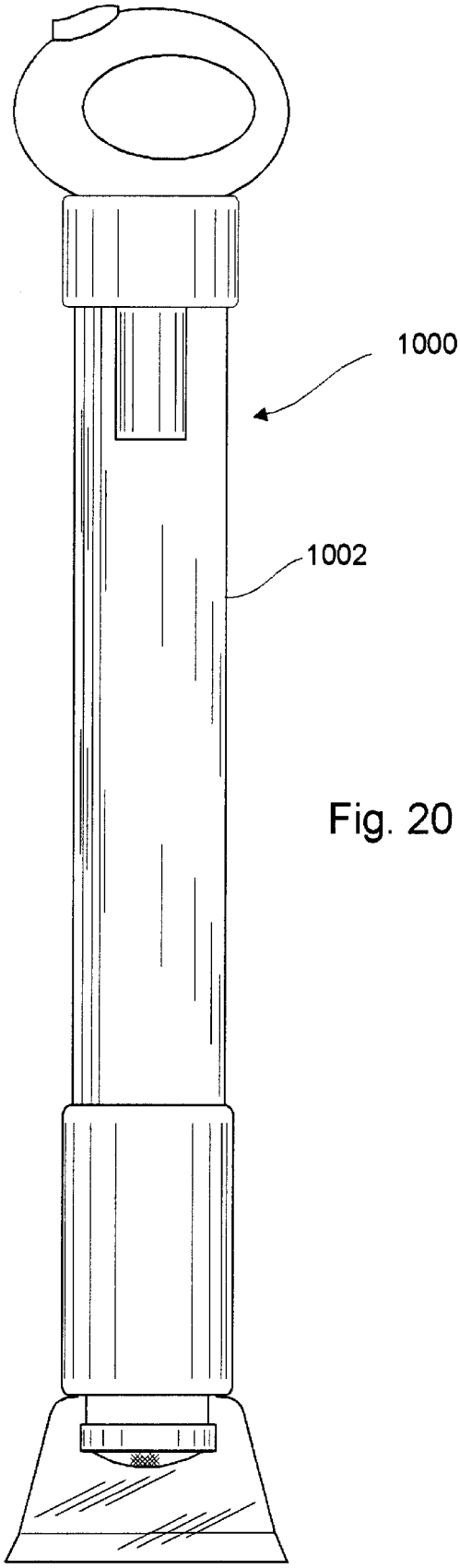
FIG. 20 illustrates a side view of another embodiment of the invention.
Figure 21:
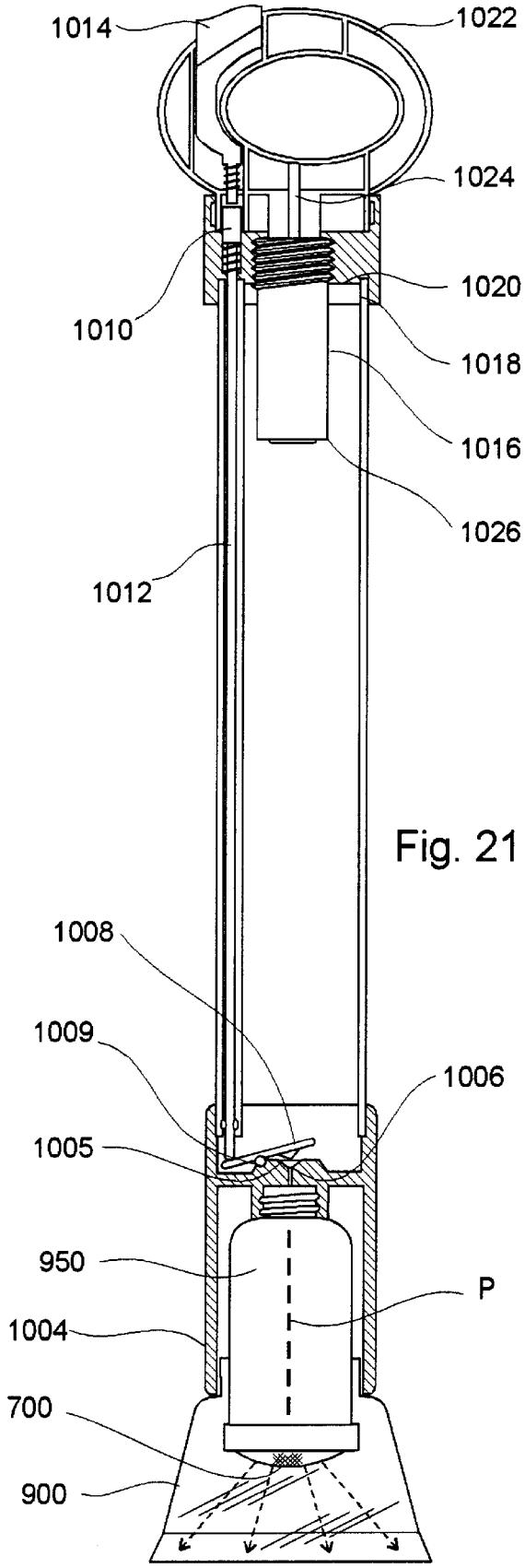
FIG. 21 shows a cross-section view of FIG. 20.

FIGS. 20 and 21 depicts yet another embodiment. The applicator 1000 varies in part in providing a liquid reservoir 1002 which is shown here as a generally tubular container which is coaxially disposed along the path P. An end 1004 is adapted to receive an end of windshield 900. An internal chamber 950 connects to the diffuser screen 700 in a manner as previously described. Longitudinally disposed from the end 1004 is a valve mechanism 1005 (seen in FIG. 23) which includes a port 1006, valve door 1008 having a pivot point 1009, and a valve door actuator 1010 which includes a movable member 1012 which is operably connected to a trigger 1014. The movable member 1012 is normally biased in a closed position by a spring 1011 and the trigger 1014 is likewise biased by spring 1013. A pump cylinder 1016 is operably connected to another end 1018 by a collar 1020. A pump handle 1022 is provided with a piston 1024 as operably connected to the pump cylinder 1016. The pump handle 1022 is designed to rotate to a first position wherein the pump piston 1024 can be reciprocated such that trigger 1014 is out of alignment with the member 1012 to avoid release of chemical.

Figure 23:
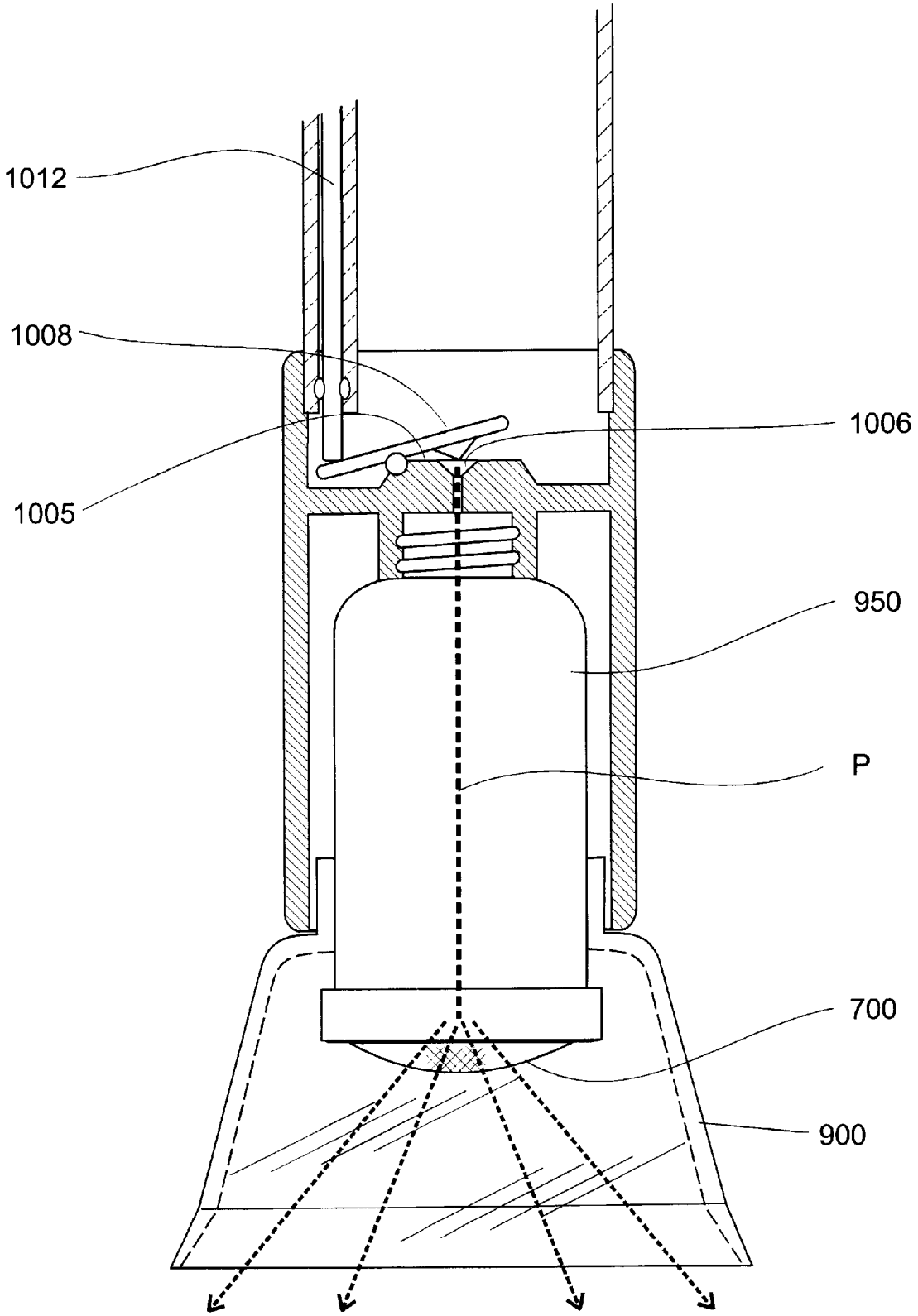
FIG. 23 shows a cross section of a lower portion of FIG. 20.
Figure 24:
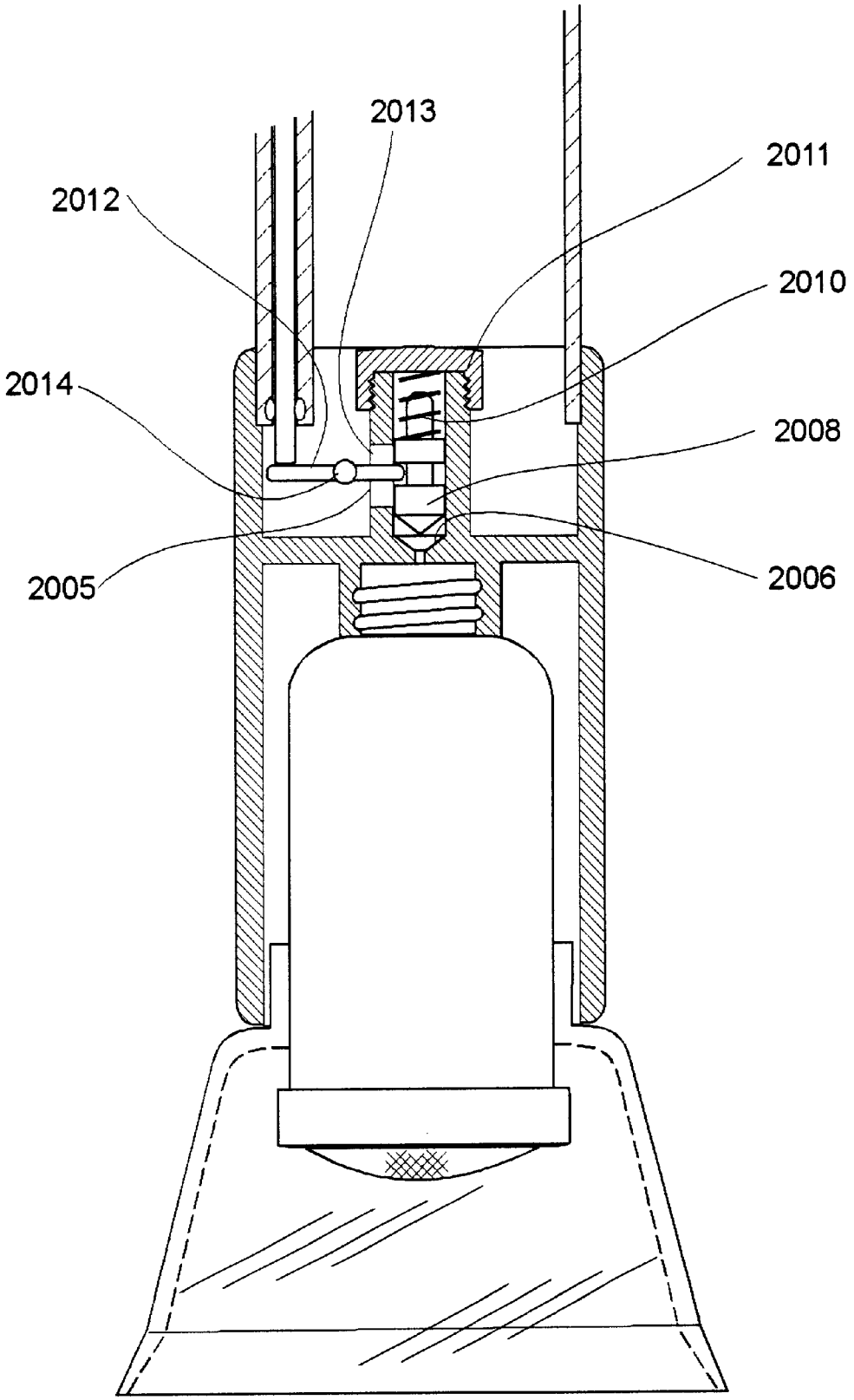
FIG. 24 shows a cross section of an alternative lower portion.

FIG. 24 shows an alternative valve mechanism 2005 in place of valve mechanism 1005 shown in FIG. 23. Here, a valve port 2006 is open and closed via a valve piston 2008 which is normally biased in the closed position by a spring 2010 all of which sits in a valve cylinder 2011 having a fluid inlet 2013, but is actuatable to an open position by an arm 2012 interconnecting the valve piston 2008 and movable member 1012. The arm 2012 includes a pivot point 2014.

Figure 22:
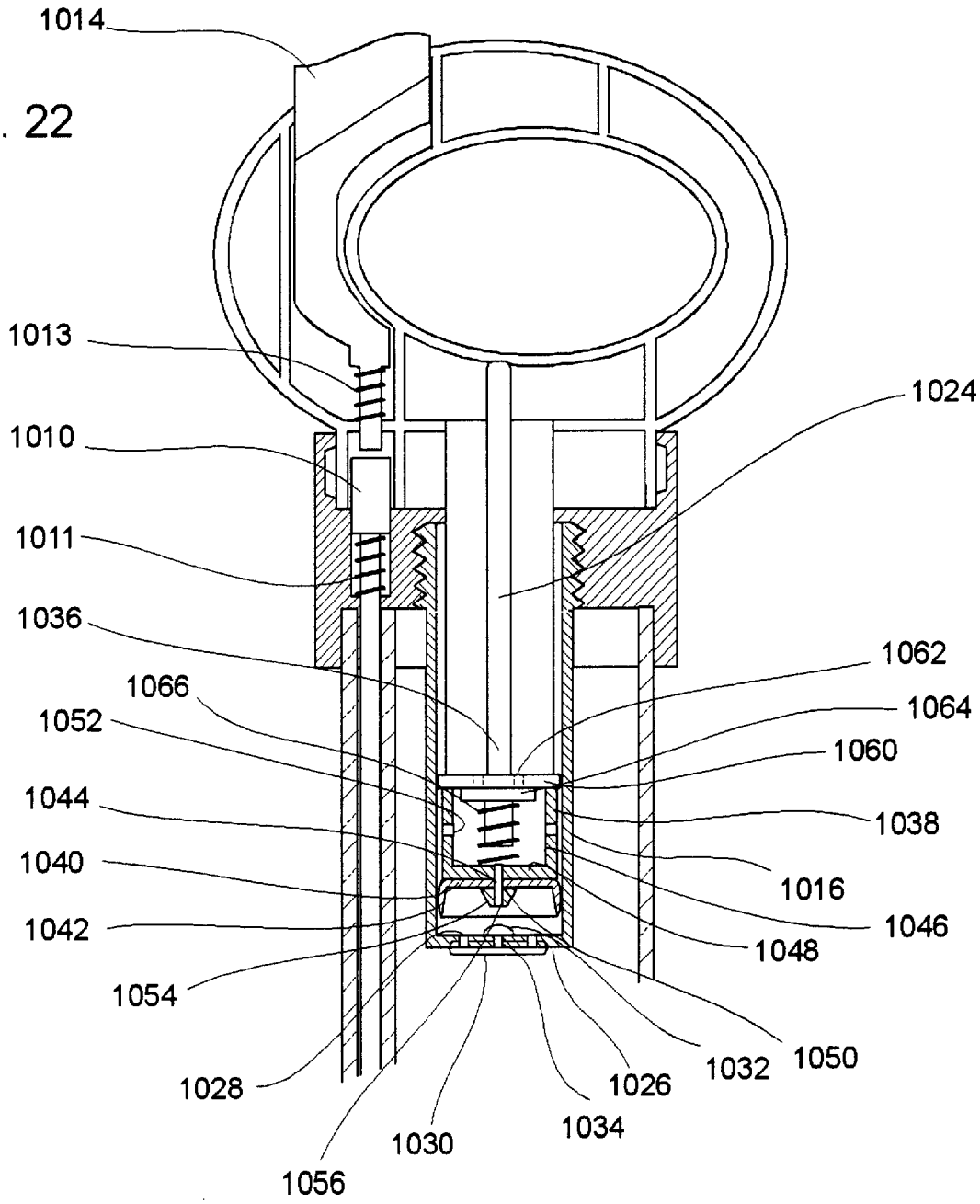
FIG. 22 shows a cross section of an upper portion of FIGS. 21 and 22.

As best seen in FIG. 22, a terminal end 1026 of the cylinder 1016 includes a plurality of openings 1028 with a flexible one way valve 1030 connected to the end 1026 via a button retainer 1032 through a connector orifice 1034. An end 1036 of the piston 1024 is provided with a one-way valve mechanism 1038.

The valve mechanism 1038 includes a lower flexible annular portion 1040 having a lip 1042 sealing against the inside of the cylinder 1016 when pushed in a downward manner yet permits air passage thereby when pulled in an upward manner. There is an open surface 1044 in the annular portion 1040. Connected to the annular portion 1040 is a generally cylindrical portion 1046 which is slightly less in diameter than an inner diameter of the cylinder 1016 has a bottom 1048 with an open surface 1050 coaxial with the open surface 1044. Additionally, there are opening surfaces 1052 in the cylindrical portion 1046. A connector 1054 interconnects the portions 1040 and 1046 and has an open surface 1056 therethrough.

An annular portion 1060 having a diameter slightly less than the inner diameter of the cylinder 1016 to permit a slidable seal therebetween is provided. The portion 1060 is separably abuts to the cylindrical portion 1046 and includes open surfaces 1062. An annular cover 1064 is operably disposed on the end portion 1036 and seals opening surfaces 1062 when portion 1060 abuts thereto. A spring 1066 operably interconnects the cover 1064 and the bottom 1048. When the piston 1024 is reciprocated, the air flow is permitted to flow passed the valve mechanism 1038 in one stroke and prevented in an opposite stroke.

Figure 25:
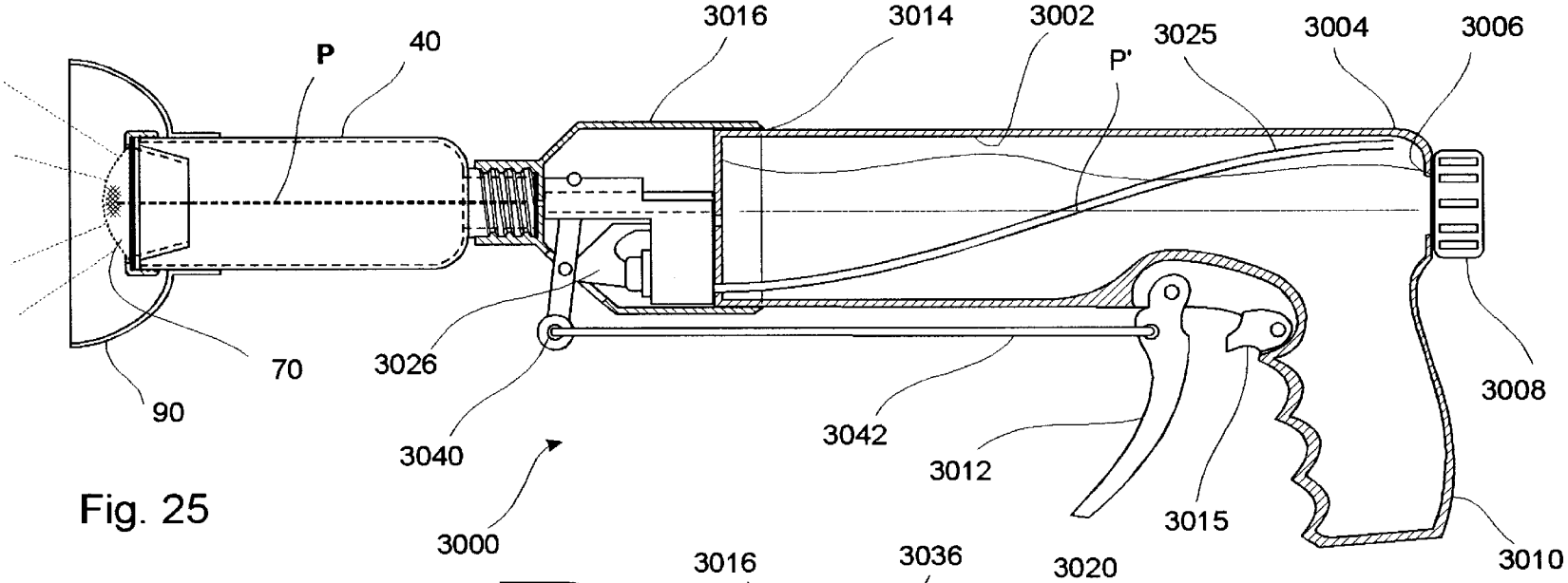
FIG. 25 shows yet another embodiment.
Figure 26:
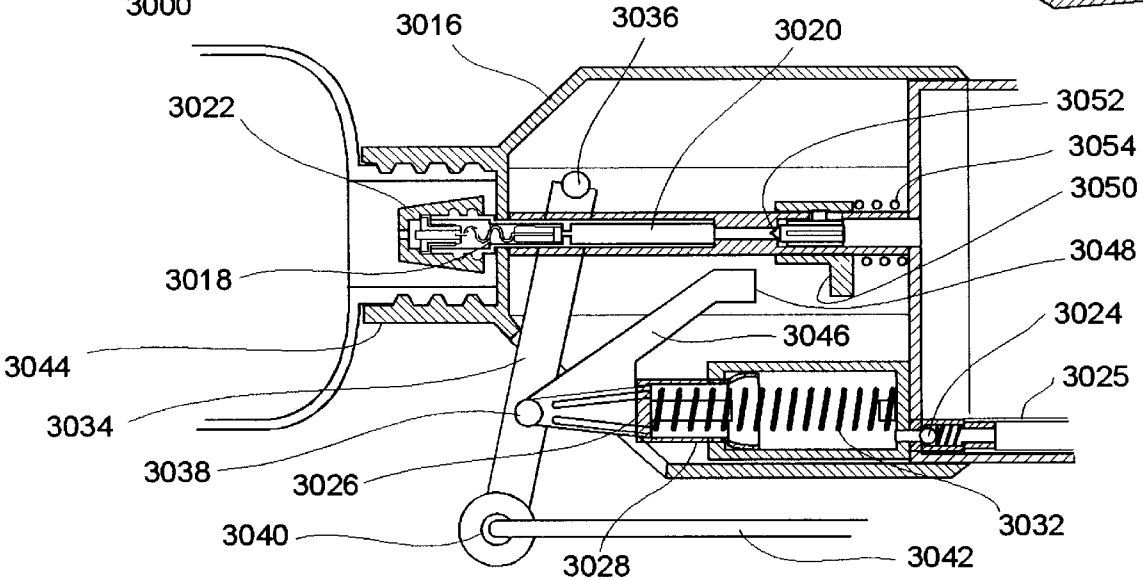
FIG. 26 shows a cross section of a portion of FIG. 25.

Finally, FIGS. 25–26 depict yet another embodiment. Here, there is disclosed an elongated sprayer device 3000. The device 3000 includes a chemicals container portion 3002 which is generally cylindrical and coaxially disposed about an axis P' which is commonly co-extending with path P.

At one end 3004 is a fill port 3006 with an associated cap 3008 sealably connected thereto. Also, provided is a handle portion 3010 having an operable pull trigger 3012 and trigger stop 3015 to limit travel of the trigger 3012.

Another end 3014 includes a pump head 3016. The pump head 3016 has an orifice 3018 through which liquid chemicals pass via a chamber 3020 and nozzle 3022. The chamber 3020 communicates with a nozzle passage 3022 which in turn communicate with the container portion 3002.

A pump 3026 is provided with a piston 3028 within a cylindrical 3030. The piston 3028 is normally biased by a spring 3032 to a peak potential stroke position. An arm 3034 includes hinge points 3036, 3038 and 3040. A connector rod 3042 interconnects arm 3034 and trigger 3012.

An arm 3046 is provided on the pump 3026 and has an end 3048 for engagement with a flange 3050. The flange 3050 is part of a valve 3052 which is movably disposed on chamber 3020. The valve 3052 is normally biased in a closed position by a spring 3054.

Upon actuation of the trigger 3012., the pump 3026 operates via the piston 3028 reciprocating with air pressure driving a ball type valve 3024 to an open position causing air flow though a conduit 3025 into the container 3002 and build pressure therein. The trigger stop 3015 pivots into a blocking position to block full actuation of trigger 3012.

The stop 3015 pivots to a non-blocking position to permit full actuation of the trigger 3012. This causes engagement of the end 3048 with the flange 3050 and opening of valve 3052 which results in fluid flow to be released through the nozzle 3022. The pump head 3016 has a threaded neck 3044 to receive a chamber 40 as described with prior embodiments.

Figure 27:
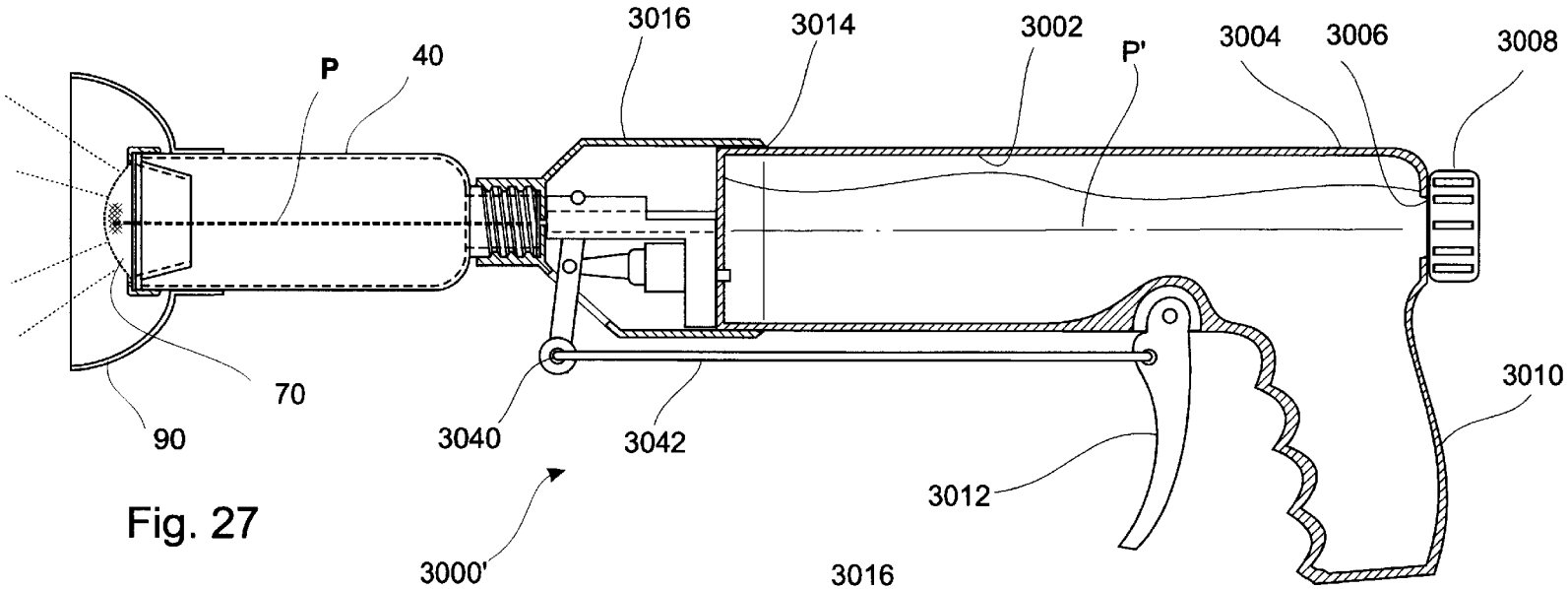
FIG. 27 shows yet another embodiment.
Figure 28:
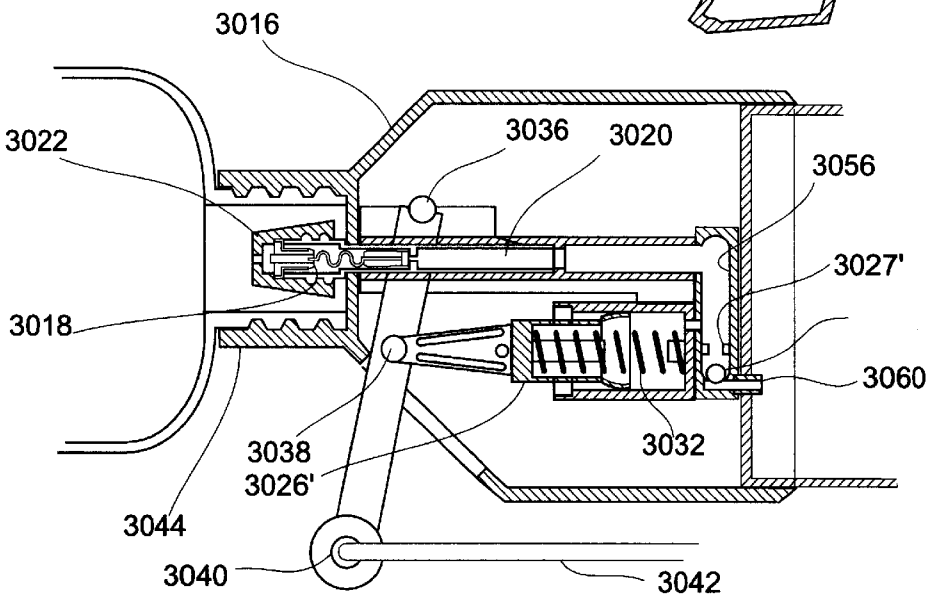
FIG. 28 shows a cross section of a portion of FIG. 27.

FIGS. 27–28 depict a similar device 3000' to the embodiment just described with differences residing in the ball type valve 3024' and chamber 3056. Here, the valve 3024' is a float type ball valve held in travel by a stop 3027'. When the pump 3026' is operated, fluid is driven out the nozzle 3022 via chamber 3056.

Figure 29:
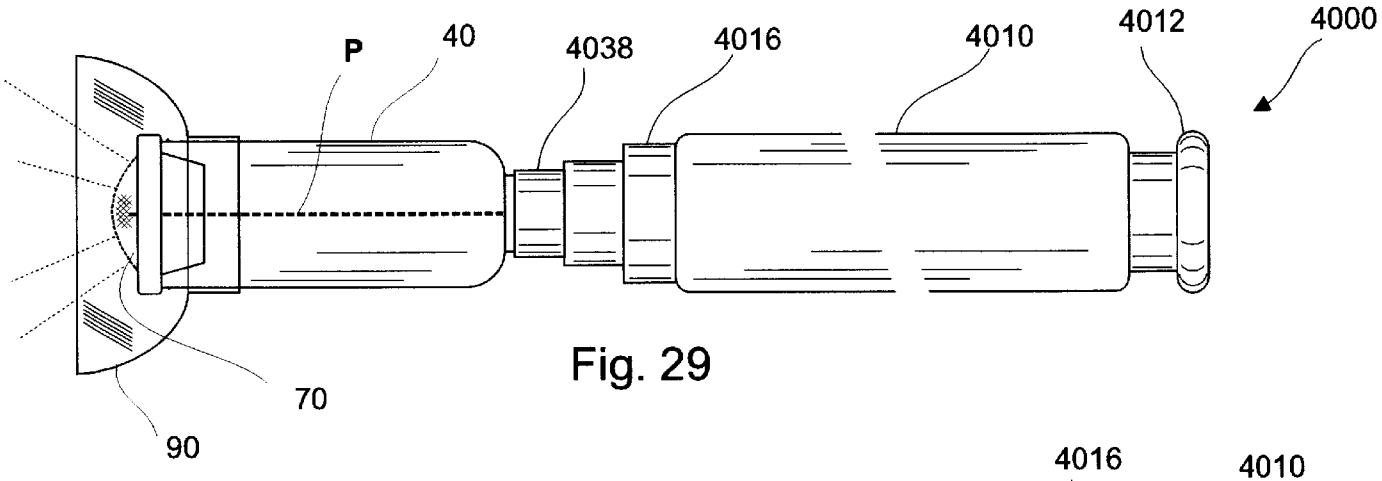
FIG. 29 shows yet another embodiment of the invention.
Figure 30:
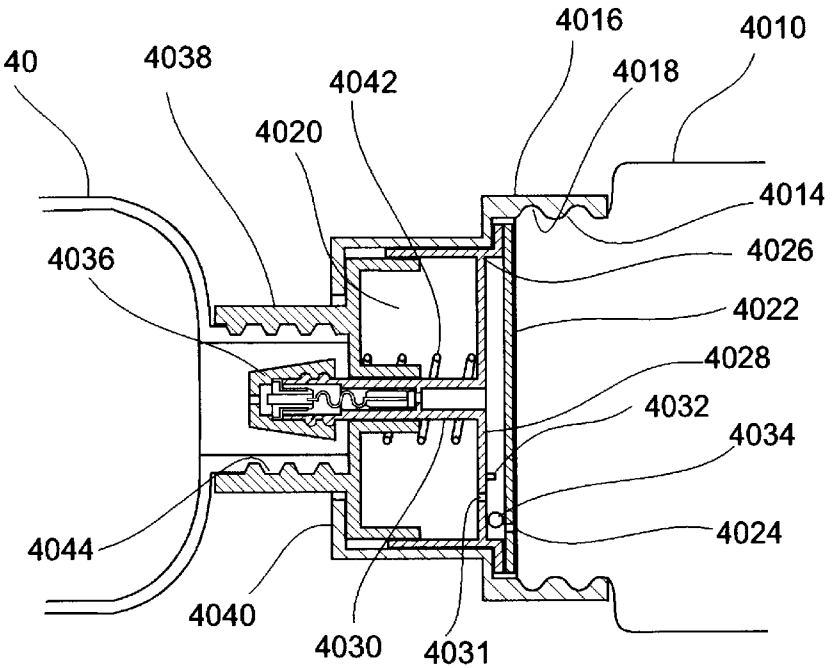
FIG. 30 shows a cross section of a portion of FIG. 29.

FIGS. 29 and 30 disclose yet another embodiment of the invention. Here, the device 4000 includes a housing 4010 with an operably reciprocally disposed pump 4012. The housing 4010 includes an outer male threaded end 4014.

A coupler 4016 includes an inner threaded end 4018 to connect to the end 4014. A valve mechanism 4020 includes a valve plate 4022 having a valve open surface 4024. An insert 4026 is disposed in the coupling 4016 and includes an annular portion 4028 and a cylindrical portion 4030 which extends from the annular portion 4028 and permits fluid to pass therethrough. A stop 4032 extends from the annular portion 4028 toward the valve plate and further includes a port surface 4031. A check ball 4034 is movably retained in an area between the valve open surface 4024 and the stop 4032 with the port surface therebetween. A nozzle 4036 of the type previously discussed is disposed in the cylindrical portion 4030.

Slidably sealably disposed in the insert 4026 is a chamber connector 4038 which is normally biased against a retaining lip 4040 of the coupler 4016 by a spring 4042. The chamber connector 4038 has a complimentary configuration to the insert 4026 as shown such that when reciprocated back and forth, can displace volume of fluid therebetween and thus force fluid out of the nozzle 4036. The chamber connector 4038 includes a threaded internal surface 4044 to which the chamber 40 is connected.

When pressure derived from the connector 4038 drives the ball 4034 to a stopping point adjacent the valve open surface 4024, the ball 4034 prevents fluid from passing thereby and fluid passes through the port surface 4031 and out the cylindrical portion 4030 and nozzle 4036. Pressure derived from the pump 4012 causes the ball 4024 to move against the stop 4032 and fluid flows into the area between the connector 4038 and insert 4026.

Optionally, applicators with elongated rearward auxiliary handle and trigger assemblies such as those illustrated above may incorporate those assemblies as field removable features to allow for more compact applicator configurations as may be desired. Generally the elongated auxiliary handle and trigger features readily allow the user to avoid bending altogether for most chemical applications. Where these parts are readily removable, as by incorporating threaded cap rings or the like, caps or covers may be provided to seal exposed openings.

In the different embodiments of the invention thus far specifically described herein, pressurized liquid chemicals are delivered to an orifice of a discharging jet or nozzle for ejection as a liquid stream. For this purpose, conventional pressure activated pump head, check valve and pump trigger mechanisms may be used as illustratively described. However, it will be appreciated that other delivery elements are well known and may alternatively be used. For example, liquid chemical pressurization may be alternatively achieved using various conventional hand or motorized pumps, or other gas or liquid pressurization devices, or $CO_2$ cartridges or the like, to build ejection pressures at the ejection port or generally within the liquid chemical reservoir. Liquid chemical ejection may be controlled using various trigger mechanisms to mechanically or electrically activate liquid supply valve or pressure regulated check valve devices in a well known manner.

For example, in variations of the embodiments shown above, the liquid chemical reservoir may alternatively reside within the elongated handle portion of the applicator, obviating the need for an attached reservoir bottle as illustrated. Liquid chemicals could be introduced through a capped opening (not shown) in the upper side of the handle and pressurized in the reservoir using a thumb operated pump, slide valve pump, or other hand operated pump mechanism (not shown). The rearwardly positioned finger actuated trigger could control the liquid chemical ejection by controlling the liquid supply to a discharging jet 22 through an ejection pressure control assembly 24 of the type previously described.

It should be similarly appreciated that the shapes and manner of assembly of the different functional elements of the described embodiments are exemplary and admit of a range of variations. For example, while different threaded connections, collars and cap ring connectors are illustratively described. glued, clamped or friction fittings might also be used. Similarly, integrated componentry can be used and may be advantageous in lowering the cost of manufacturing and simplifying assembly and servicing.

The above described embodiments are thus set forth by way of example and not for the purpose of in any way limiting the disclosed invention. It will be readily apparent to those skilled in the art that any number of modifications, derivations and variations can be made to the described embodiments without departing from the scope of the invention as claimed. The claims appended hereto should be accorded their full scope as including any such modifications, derivations and variations as may be implemented.

What is claimed is:

1. An applicator for dispersing liquid chemical onto targeted vegetation comprising:

an orifice through which pressurized liquid chemicals are introduced and ejected as a liquid stream in a predetermined path;

a liquid chemical reservoir in the form of a container having a connectable opening and a pump head having said orifice disposed therein and connected to said container wherein said container includes a separate refill port surface;

a diffuser screen in a sufficiently longitudinally spaced relation from said orifice surface and transversely extending across said predetermined path such that said liquid chemical is dispersed in an expanded pattern sufficient to cover targeted vegetation upon passing through said diffuser screen; and means for holding said diffuser screen in said longitudinally spaced relation to avoid directly contacting said discharged stream of liquid chemical along said predetermined path.

2. The applicator of claim 1, including a windshield connected to holding means and having a terminal end projecting downstream of said diffuser screen.

3. The applicator of claim 2, in which the windshield has flared end.

4. The applicator of claim 2, wherein said windshield includes a flat surface.

5. The applicator of claim 1, wherein said holding means further includes a wind guard chamber adjacent to said orifice through which the liquid stream is passed over a predetermined length.

6. The applicator of claim 5, including a drip ring within said wind guard chamber upstream of said diffuser screen.

7. The applicator of claim 5, including a windshield connected to holding means and having a terminal end projecting downstream of said diffuser screen and wherein said wind guard chamber and said windshield are constructed of a generally transparent material.

8. The applicator of claim 5, wherein said chamber is generally coaxially disposed along said predetermined path.

9. The applicator of claim 5, wherein said orifice is generally disposed at one end of said chamber and which further includes a pump head actuator disposed at another end of said chamber distal from said orifice.

10. The applicator of claim 9, which further includes one of a manual and an automated actuator at said distal end.

11. The applicator of claim 1, in which said liquid chemical reservoir has an angled neck forming an integral bent handle by which the applicator may be held.

12. The applicator of claim 1, in which said liquid chemical reservoir is a straight-necked bottle, and in which said applicator includes a bent handle adapter connecting said applicator to said reservoir forming an angled handle by which said applicator may be held.

13. The applicator of claim 1, in which said diffuser screen has a variable effective screen size and configuration to accommodate efficient use of different liquid chemicals and different conditions of use.

14. The applicator of claim 1, in which said orifice surface is incorporated within a nozzle at an end of a fluid extension conduit.

15. The applicator of claim 14, wherein said holding means includes a clamp connected to said fluid extension conduit.

16. The applicator of claim 1, including an elongated handle rearward of said orifice surface.

17. The applicator of claim 16, in which said elongated handle is bent to facilitate holding of said applicator when in use.

18. The applicator of claim 16, in which said elongated handle includes a trigger for controlling flow of liquid chemicals through said orifice surface.

19. The applicator of claim 16, including a liquid chemical reservoir resident within the elongated handle to supply liquid chemicals to be ejected through said orifice surface, there being a capped opening in an upper side of said handle to supply said liquid chemical reservoir with liquid chemicals.

20. The applicator of claim 1, which further includes means operably connected to said orifice surface for causing pressurized liquid chemicals to flow through said orifice.

21. The applicator of claim 1, which further includes an automated compressor connected to said pump head.

22. The applicator of claim 1, wherein said diffuser screen is one of generally arcuate and generally flat.

23. The applicator of claim 1, including a liquid chemical reservoir in the form of a chamber disposed about a central axis along said predetermined path.

24. The applicator of claim 23, which includes a trigger connected to said pump head for controlling flow of liquid chemicals through said orifice surface.

25. The applicator of claim 23, including a windshield connected to holding means and having a terminal end projecting downstream of said diffuser screen.

26. The applicator of claim 1, wherein said container is elongated.

27. The applicator of claim 26, wherein said container has a handle on a distal end thereof with respect to said orifice.

28. An applicator for delivering liquid chemical to targeted vegetation, wherein the applicator includes:

a portably unrestricted self-contained liquid reservoir in the form of a container connected to a pump head communicably connected to a liquid chemical reservoir and having an orifice surface through which pressurized liquid chemicals are introduced and ejected as a liquid stream in a predetermined path, wherein said pump head is one of manual and automatic operation capable of discharging said liquid chemical is said predetermined path, said container including a separate refill port surface;

an extension member having an inner surface sufficiently spaced from said path to avoid directly contacting the discharged stream of liquid chemical along said predetermined path, and having a predetermined length sufficient to provide a well defined stream of liquid therethrough, a first end connectable to said pump head in a relatively fixed position with respect thereto, and a second end connected to said first end, said extension member being generally laterally disposed from a central axis along said predetermined path and substantially over said predetermined length; and a diffuser screen connected to said second end of said extension member and being spaced from said pump head and extending transversely across said predetermined path such that the liquid chemical is dispersed in an expanded pattern sufficient to cover the targeted vegetation upon passing through said diffuser screen.

29. The applicator of claim 28, which further includes a wind shield connected to said extension member adjacent said diffuser screen, wherein said wind shield extends from said extension member in a manner to shield liquid chemical from wind as it is dispersed through said diffuser screen.

30. The applicator of claim 28, wherein said diffuser screen has an arcuate shape.

31. The applicator of claim 28, which includes pump trigger rearwardly disposed from said orifice surface.

32. The applicator of claim 18, wherein said diffuser screen has a variable effective screen size and configuration to accommodate efficient use of different liquid chemicals and different conditions of use.

* * * * *